US006632100B1

(12) United States Patent
Richardson

(10) Patent No.: US 6,632,100 B1
(45) **Date of Patent: *Oct. 14, 2003**

(54) LIGHTING SYSTEM METHOD AND APPARATUS SOCKET ASSEMBLY LAMP INSULATOR ASSEMBLY AND COMPONENTS THEREOF

(75) Inventor: Richard J. Richardson, Simi Valley, CA (US)

(73) Assignee: Anthony, Inc., San Fernando, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/839,125

(22) Filed: Apr. 23, 1997

(51) Int. Cl.[7] ..... H01R 33/02
(52) U.S. Cl. ..... 439/242; 439/230
(58) Field of Search ..... 439/271, 272, 439/280, 277, 182, 619, 851, 226, 227, 228, 229–244, 611, 612, 613, 614, 617, 618; 362/429, 220, 217, 260, 396

(56) References Cited

U.S. PATENT DOCUMENTS

| | | | | | |
|---|---|---|---|---|---|
| 1,872,593 | A | * | 8/1932 | Hough | 439/230 |
| 1,878,229 | A | * | 9/1932 | Beck | 439/244 |
| RE21,545 | E | | 8/1940 | Marshaus | |
| 2,295,883 | A | * | 9/1942 | Williams | 439/230 |

(List continued on next page.)

FOREIGN PATENT DOCUMENTS

| | | | |
|---|---|---|---|
| AU | 56486/94 | B | 1/1995 |
| DE | 0830221 | C | 1/1952 |
| DE | 0830221 | C | 2/1952 |
| DE | 1020733 | | 5/1954 |
| DE | 2644664 | | 4/1978 |
| DE | 2644664 | A | 6/1978 |
| DE | 3638507 | A | 5/1988 |
| DE | 4013271 | A | 10/1991 |
| FR | 2611319 | A | 8/1988 |
| JP | 0403273 | | 8/1993 |
| JP | 04032731 | | 8/1993 |
| JP | 04168601 | | 12/1993 |
| JP | 05257787 | | 4/1995 |
| SU | 1120435 | | 10/1984 |

OTHER PUBLICATIONS

U.S. 08/919,947 & Claims, Aug. 29, 1997, Richardson, pending.
U.S. 09/069,457 & Claims, Apr. 28, 1998, Richardson, pending.
U.S. 09/341,654 & Claims, May 19, 1999, Richardson, pending.
U.S. 09/604,780 & Claims, Jun. 26, 2000, Richardson, pending.
Lampholder and Wiring Devices, voltarc Technologies, Inc., Copyright 1995.

*Primary Examiner*—Ross Gushi
(74) *Attorney, Agent, or Firm*—Jeffer, Mangels, Butler & Marmaro LLP

(57) ABSTRACT

A socket is described for a lighting assembly having a socket body and an electrical connector with a seal in the socket to seal around a light source. The socket is preferably configured to be independent of the mounting arrangement for the lighting assembly. An insulator is also disclosed for a lamp such as a fluorescent lamp having a body which covers the contact on the lamp so as to form a recessed lamp conductor. The combination of a socket and lamp insulator is also disclosed for providing a socket and insulator assembly for reducing the possibility of injury or damage due to high open circuit voltage, environmental effects and the like. Additionally, a lighting assembly is disclosed incorporating the insulator, socket and mounting arrangements.

69 Claims, 4 Drawing Sheets

U.S. PATENT DOCUMENTS 2,319,736 A * 5/1943 Jarmolowsky ..... 315/95
2,356,601 A 8/1944 MacCarthy
2,369,123 A * 2/1945 Abshire ..... 250/45.11
2,399,531 A 4/1946 Young
2,447,676 A 8/1948 Webster
2,476,856 A 7/1949 Geenens
2,483,165 A 9/1949 Young
2,495,196 A 1/1950 Kulka
2,522,044 A 9/1950 Kelman
2,626,976 A * 1/1953 Howenstine ..... 439/237
2,709,792 A * 5/1955 Peters ..... 439/242
2,715,216 A 8/1955 Howenstine
2,716,738 A 8/1955 Pistey
2,716,739 A 8/1955 Lemmers
2,733,420 A 1/1956 Marz
2,742,621 A 4/1956 Pistey
2,760,053 A * 8/1956 Choisser ..... 439/242
2,774,947 A 12/1956 Frensch
2,857,578 A 10/1958 Thomas
2,922,137 A 1/1960 Krupp et al.
2,983,838 A 5/1961 Pechy
2,984,812 A 5/1961 Caferro
2,995,723 A 8/1961 Shappell et al.
3,005,971 A 10/1961 Lennox
3,026,496 A * 3/1962 Gluck ..... 439/851
3,111,353 A 11/1963 Nelson
3,116,098 A 12/1963 Kulka
3,181,103 A 4/1965 Fedorick
3,287,688 A 11/1966 Laurenzo
3,327,281 A 6/1967 Johnson
3,353,140 A 11/1967 Johnson
3,384,858 A 5/1968 Johnson
3,398,391 A 8/1968 Brishka
3,422,393 A * 1/1969 Plagge ..... 439/615
3,426,234 A 2/1969 Hayasaka et al.
3,430,189 A 2/1969 Landgraf
3,660,800 A 5/1972 Detch
3,685,003 A 8/1972 Watt
3,720,826 A 3/1973 Gilmore et al.
3,751,653 A 8/1973 Henry
3,771,106 A 11/1973 Matsumoto et al.
4,039,886 A 8/1977 Scherzer
4,080,030 A 3/1978 Ustin
4,084,873 A 4/1978 Grate
4,102,558 A 7/1978 Krachman
4,147,947 A 4/1979 Hoeh
4,198,108 A 4/1980 Bassetto
4,198,109 A 4/1980 Ustin
4,238,815 A 12/1980 Price
4,280,169 A 7/1981 Allen
4,350,400 A 9/1982 Gaynor
4,383,288 A 5/1983 Hess, II et al.
4,565,415 A 1/1986 Feinberg
4,573,754 A 3/1986 Hill
4,660,916 A 4/1987 Williams, Jr.
4,758,173 A 7/1988 Northrop
4,772,216 A 9/1988 Szymanek
4,814,954 A 3/1989 Spitz
4,854,888 A 8/1989 Cannon
4,863,394 A 9/1989 Henshaw, Jr.
4,878,854 A 11/1989 Cannon
4,904,903 A 2/1990 Pacholok
4,928,209 A 5/1990 Rodin
4,955,044 A 9/1990 Amstutz et al.
4,992,915 A 2/1991 Meister
4,994,710 A 2/1991 Roelevink et al.
5,006,970 A 4/1991 Mackiewicz
5,009,617 A 4/1991 Thomas
5,069,633 A 12/1991 Straka et al.
5,122,074 A 6/1992 Maag et al.
5,132,885 A 7/1992 Hocheim
5,154,638 A * 10/1992 Sireul et al. ..... 439/611
5,169,331 A 12/1992 Caldwell et al.
5,188,451 A 2/1993 Shanks
5,192,218 A 3/1993 Kuiper
5,282,755 A 2/1994 Ahlstone
5,311,097 A 5/1994 Mepham et al.
5,320,547 A * 6/1994 Mews et al.
5,354,208 A * 10/1994 Salaski et al. ..... 439/230
5,368,495 A 11/1994 Raby, Sr.
5,381,321 A 1/1995 Fearing, Jr. et al.
5,448,460 A 9/1995 Belfer et al.
5,452,187 A 9/1995 Belfer et al.
5,469,348 A 11/1995 Wong
5,521,804 A 5/1996 Degelmann et al.
5,616,042 A 4/1997 Raby, Sr. et al.
5,636,919 A 6/1997 Walker
5,688,139 A 11/1997 Gust et al.
5,700,082 A * 12/1997 Peng ..... 439/619
5,720,546 A 2/1998 Correll, Jr. et al.
5,727,869 A * 3/1998 Crosby et al. ..... 439/242
5,768,898 A 6/1998 Seok et al.
5,797,675 A * 8/1998 Tanner, Jr. ..... 362/396
5,855,487 A 1/1999 Kunishi
5,904,415 A * 5/1999 Roberstson et al. ..... 362/260
6,007,362 A 12/1999 Davis et al.
6,193,534 B1 2/2001 Burwell et al.

* cited by examiner

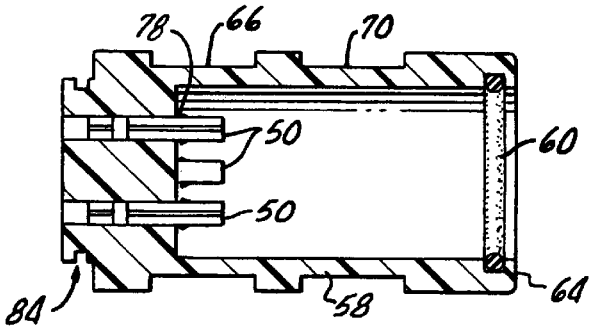
FIG. 2.
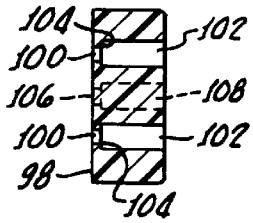
FIG. 3.
FIG. 6.
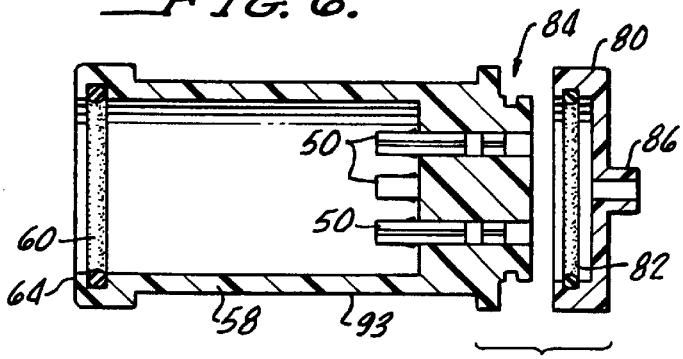
FIG. 7.
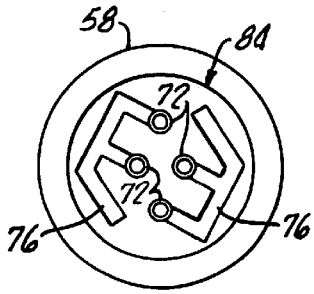
FIG. 12.
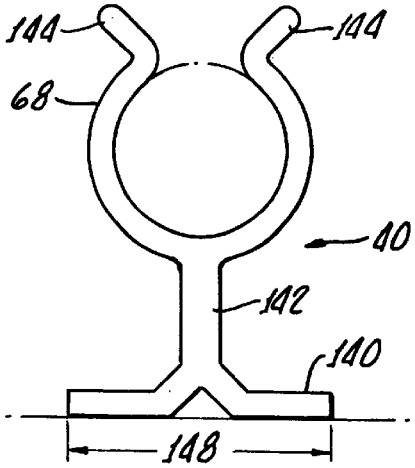
FIG. 13.
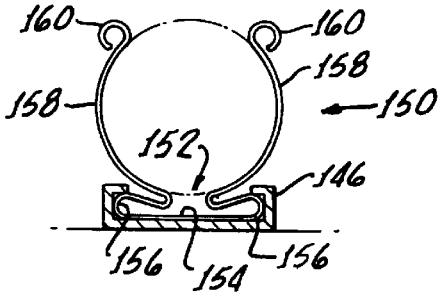

LIGHTING SYSTEM METHOD AND APPARATUS SOCKET ASSEMBLY LAMP INSULATOR ASSEMBLY AND COMPONENTS THEREOF

BACKGROUND OF THE INVENTION

A. Field of the Invention

This invention relates to lighting systems, and components and assemblies for lighting systems, such as socket assemblies and lamp insulator assemblies, used in lighting systems. One aspect of an embodiment of the invention relates to fluorescent lamp sockets and mounting arrangements for such sockets, while another aspect relates to fluorescent lamp insulators.

B. Related Art

The use and operation of fluorescent lighting systems are affected by a number of factors. One factor is safety, one purpose being to minimize the possibility of electrical shock to personnel, including customers, maintenance personnel and the like. Another factor is the lighting system dimensions, including the lamp size, size of electrical contacts, and the positioning of electrical contacts. A further factor includes environmental considerations, such as the operating temperature, and the surrounding temperature. Environmental considerations also include humidity, especially where the surrounding temperature may result in moisture condensation or icing. Another consideration under the category of environment includes operating conditions such as vibration, impact, and protection from other mechanical factors. Another factor includes ease of installation, repair and replacement, including interchangeability or variability of parts and lamps in the lighting system. A further consideration is how the lighting system is electrically driven. Each of these factors will be discussed more fully below.

The majority of present lighting systems are electrically driven. Standards have been established for design, certification and approval of most lighting systems for the protection of personnel, such as occupants, customers, installation and repair personnel, as well as others. Such standards include insuring that personnel are not exposed to high, voltage or electric shock during installation or replacement of lighting elements such as lamps and bulbs. For example, most household incandescent bulbs have the hot and neutral contacts positioned relatively close to each other so that installation of the bulb does not produce an exposed live contact. The risk of shock is minimized for the user by grasping the relatively low conductive glass portion of the bulb, and the contacts become live only after the bulb is substantially threaded into the socket. A common design for fluorescent sockets minimizes the possibility of electrical shock by having each end of the lamp inserted into respective sockets and seated or rotated a given amount before electrical contact occurs. This minimizes the possibility of having an exposed live contact. Another design of fluorescent sockets has one socket spring loaded so that the socket can be depressed with one end of the linear lamp inserted into the socket to permit enough spacing for the opposite end to be inserted into its respective socket. However, there is still a possibility that the opposite end of the lamp could be live before it is inserted into its corresponding socket. U-shaped fluorescent lamps and lamps having other shapes significantly different from the traditional linear shapes are comparable in some ways to traditional incandescent household bulbs in that the electrode contacts are closer together. As a result, the likelihood that shock may occur is somewhat reduced.

While incandescent lamps are generally driven off line voltage, fluorescent lamps typically require a ballast to start the lamp and regulate the power applied to the lamp. The voltage required to start the lamps depends on the lamp length and its diameter, with larger lamps requiring higher voltages. The ballast is designed to provide the proper starting and operating voltage required by the particular lamp. The ballast provides the proper voltage to fire the lamp and regulates the electric current flowing through the lamp to ensure stable light output. The ballast also supplies a correct voltage for the desired lamp operation and adjusts for voltage variations.

Traditionally, ballasts were of the electromagnetic, solid core type having a large transformer for providing the desired voltage and current. The voltage was typically provided to the lamp at or near the operating line voltage of 120 volts or 240 volts and frequency of 60 Hertz or 50 Hertz, respectively. Occasionally, the lamp is driven at a higher current in order to enhance the light output, but such overdriving of the lamp typically results in a shorter lamp lifetime.

Electronic or solid state ballasts provide greater energy efficiency by converting the power to light more efficiently than electromagnetic ballasts. Therefore, it is possible that an electronic ballast can provide a greater light output than an electromagnetic ballast with the same power consumption. The higher efficiency and light output is achieved by operating at a higher frequency than line frequency, and sometimes by operating at a higher voltage. As a result, it is possible that a ballast could acquire a relatively high open circuit voltage, as high as 750 volts, such as after ballast failure or some other electrical failure in the lighting system, which could consequently lead to injury or damage. For example, an improperly connected lamp in its respective sockets could lead to a high open circuit voltage, which in turn could cause arcing, over-heating, possible lamp failure and possible ballast failure.

Because of the higher driving voltages, the connection between the ballast and the lamp or bulb is important. Typically, fluorescent lamps have included bi-pin contacts or double recessed contacts at each end of the fluorescent tube. The pins are separated by a predetermined center-to-center pin separation distance, which may vary according to the size of the lamp. For larger diameter lamps, the spacing can be larger for recessed double contact lamps such as some T-10 and T-12 lamps, but otherwise will be the same for bi-pin T-8, T-10 and T-12 lamps. For example, a T-12 double recessed contact lamp will have a larger center-to-center contact spacing than a T-8 bi-pin lamp. The number 12 and the number 10 refer to the size, in eighths of an inch, of the lamp diameter.

Much of the hardware used with the T-12 and T-10 lamps have been relatively standardized. In one form of socket, commonly referred to as the tombstone socket, the pins of each end of the lamp are inserted sideways into the socket until the lamp is centered in each socket. After being centered, the lamp is rotated about its longitudinal axis, allowing the pins to come into contact after rotation with the contacts in each socket. This socket minimizes the possibility of one end of the lamp being inserted into one socket with subsequent energization of the lamp and the opposite free end being live. A shock could result from a live free lamp end.

In the tombstone style of socket, contact and illumination of the lamp is achieved by electrical contact between part of the outer surface of each pin and a portion of the surface of the contact. However, the electrical contact for each pin occurs only over a relatively small surface area, estimated to be in some circumstances about 0.015 square inches. As a result, any high current through the lamp results in a relatively,higher current density at the pins.

Another conventional socket for T-10 and T-12 lamps is a spring-biased recessed double contact socket, whereby one end of a lamp is inserted into the spring-biased socket, depressing the biased portion of the socket. Depressing the socket permits insertion of the opposite end of the lamp into the stationary socket on the fixture. However, nothing prevents the free end of the lamp from having a voltage and a potential for electric shock. While this socket configuration may account for expansion and contraction due to thermal cycling and extreme environmental conditions, the potential for electric shock remains.

Bulb size also affects the safety and efficacy of lighting systems. The longer the fluorescent lamp, for example, the greater the current required to fire and maintain the lamp at the desired output. That greater current must be passed through the socket, across the socket conductors and to the pins of the lamp. With some socket designs, the current density may be relatively high between the socket and the pins for longer lamps. Consequently, overheating or other effects may occur.

Longer lamps also require a greater center-to-center distance between sockets. In conventional fixtures, the sockets are rigidly mounted to a fixed substrate that may contract or expand with changing environmental conditions. For example, in very low temperature situations such as out of doors or in freezer environments, the contraction could be a matter of sixteenths or eighths of an inch. For fixed sockets, such as tombstone-style sockets, the contraction over a large center-to-center distance between the sockets could force the sockets to bend away from the lamp, reducing the contact surface area between the socket and the lamp pins, as well as possibly disconnecting the lamp from the socket. Separation or disconnection of the lamp from the socket could cause arcing, overheating, or possible electric shock.

Conventional sockets leave portions of the lamp end exposed to environmental conditions. Such sockets generally engage the lamp pins through contacts recessed behind a flat face that butts against the flat end face of the bulb, from which the lamp pins extend. The abutting flat faces leave a gap, allowing contaminants, moisture, and cold air to enter the gap. Contaminants and moisture from cleaning or from use or maintenance may foul or corrode the connection and moisture may condense or freeze on the contacts of the connection. Additionally, cold air around the electrode area of the lamp will decrease the operating efficiency of the lamp, as well as possibly shorten the life of the lamp.

Environmental conditions affect the operation of lighting systems, for example, by decreasing operating efficiency, exposing the fixture to moisture, and extreme temperatures. Such conditions exist in outdoor illuminated signs, outdoor fixtures, unheated storage areas, refrigeration freezer cases and boxes, and cold storage rooms. Some systems see temperatures as low as −40° F. and as high as 160° F. Therefore, expansion and contraction may cause lighting system failure in many applications. Fixed center socket systems or spring-loaded socket systems often do not accommodate such changes in socket center-to-center distances caused by expansion and contraction of the substrate to which they are mounted. Temperature extremes affect the operation of the lamp by decreasing the operating efficiency. For example, some fluorescent lamps have peak operating efficiency at about 104° F. Significant deviations from that temperature significantly decrease the efficiency of operation and output of the lamp. Higher temperatures may also contribute to overheating of the connection between the socket and the lamp. High humidity may subject the lamp-socket connection to moisture condensation around the connection, and possibly icing about the lamp-socket connection. Consequently, the possibility of arcing or shorting may be increased. Increased moisture around the socket and lamp may also corrode the metal of the lamp-socket contacts, affecting the integrity of the connection between the lamp and the socket.

Additionally, operating conditions such as vibration and other physical forces, such as impact, affect lighting system operation. Vibration may cause the lamp and socket to disconnect, which also may cause premature lamp or ballast failure. Often, ballasts will fail immediately upon disconnection. Disconnection may also cause overheating, arcing, or more serious damage. Vibration is often caused by wind, nearby operation of motors or compressors, impact, such as by maintenance crews, earthquake and, in the case of refrigeration units, slamming doors, restocking of shelves, and heavy traffic. Vibration may cause vibration or rotation of the lamp in a socket, leading to disconnection, especially where there is nothing that inhibits disconnection.

During the manufacture of lighting fixtures, the sockets are not always accurately positioned to ensure optimum connection of the lamp pins and the sockets. For example, on tombstone-style sockets, fixedly mounting the socket on the substrate several sixteenths or an eighth of an inch too close together or too far apart could lead to an improper connection. If the sockets are too close together, installing the lamps between the sockets will force one or both sockets to bend away from the lamp. Bending could cause either a poor connection or an incomplete connection with the lamp, especially where there is nothing in the tombstone socket design that inhibits disconnection in a direction longitudinally of the lamp. If one socket has a good connection, but the other socket has a poor connection or no connection at all, the affected lamp end will be live and subject to arcing or overheating and possible damage or injury. Thereafter, replacement of lamps would result in further loosening of the sockets and possible failure of the fixture.

Repair or replacement of lighting fixtures is often difficult in cases where the sockets are fixedly mounted to a substrate. Often, the substrate is not designed for easy removal and replacement of lighting sockets, further exacerbating any connection problems that might occur between lamps and sockets. Similar comments may apply in situations where lamps are replaced and where sockets are jammed or impacted during lamp removal or replacement. Loose or bent sockets increase the likelihood of connection failure. Similar problems could arise during cleaning or maintenance of the equipment surrounding the lighting fixture. For example, in refrigeration units, the lamp fixture could be jarred or jammed during cleaning or restocking of shelves.

Many conventional lamp fixtures use sockets dimensioned for only T-10 and T-12 sized lamps. However, newer T-8 and T-5 lamps are not interchangeable with T-10 and T-12 lamps, nor with each other. Therefore, interchangeability of sockets is made more difficult and interchangeability of lamp sizes for a given socket arrangement is not available. Consequently, the drawbacks discussed previously relating to replacement of sockets apply equally to interchanging one socket size or type for another.

For example, T-8 and T-5 fluorescent lamps would use different lighting fixtures under conventional designs. Some of those fixtures may have marginal lamp pin-to-pin socket terminal connections that may cause premature lamp failure, ballast burnout, and the like. Additionally, differences in lamp length between T-8 and T-5 lamps make conventional fixtures difficult to use and precluding interchangeability of lamps with having to replace fixtures. The nominal lengths for T-8 lamps are 72 inches, 60 inches, 48 inches, 36 inches and 24 inches. The nominal lengths for T-5 lamps are in standard metric lengths, corresponding to 57.05 inches, 45.24 inches, 33.43 inches, and 21.61 inches. Therefore, changing from T-8 to T-5 lamps requires a change of fixtures. Additionally, the lamp pin center-to-center spacing is different being, 0.490 for the T-8 lamp and 0.185 for the T-5 lamps.

II. SUMMARY OF THE INVENTION

Embodiments of a lighting system and components are described which minimize the possibility of electric shock due to incomplete lamp and socket connection, or due to complete electrical disconnect between a lamp and a socket connection, possibly causing a high open circuit voltage. Embodiments are also described which minimize the possibility of contamination due to cleaning procedures in equipment surrounding lighting fixtures, maintenance procedures, repair and replacement procedures, and the like. Elements are also described which provide enhanced thermal protection for more efficient lamp operation and regulation, and protect the lamp and socket connection from environmental factors, such as temperature extremes, humidity, condensation, icing and vibration. A further aspect of a lighting system and components described herein improves the construction and the procedures used in the installation, repair and replacement of lighting fixtures, and provides for a greater flexibility in, and interchangeability of, lighting elements.

In one embodiment of the invention described, a socket is provided which permits connection between the socket and the lamp that is less dependent on the specific mounting arrangement or holder, or on its positioning. Preferably, the socket and its connection to the lighting element are moveable relative to the particular mounting arrangement. The sockets described herein can be attached to one or both ends of the lighting element, such as a fluorescent lamp. They are intended to be considered more a part of the lamp than of the substrate from which the socket is supported, because the socket-lamp configuration is believed to be more significant than the particular form of the socket-substrate connection. Embodiments of the disclosed lighting system permit variants of pin alignments and lamp lengths, lamp interchangeability and provide for better support of the lamp. Several embodiments of the design also permit installation of at least two different sizes of lamps, both in terms of diameter and lamp length. Embodiments of the described invention are also particularly suited for use with solid state ballasts.

For example in one preferred aspect of the present invention, a socket includes a housing with at least one slotted or female-type connector and a cavity or enclosure for accepting a lamp into the socket. This configuration can be used with present bi-pin lamps where the lamp is inserted into the socket, and permits various other benefits, such as being able to protect the lamp, provide support for the lamp and to have a more stable electrical lamp connection. Preferably, the connector extends into the cavity or enclosure less the full length of the enclosure and may even be flush with the bottom of the enclosure, for example to permit greater insertion of the lamp in the socket if desired on the one hand, or to reduce the size of the enclosure on the other hand. Preferably the connector is one that engages, surrounds and contacts all or a significant portion of the pin that it connects to for ensuring the maximum connection surface area possible.

In accordance with another aspect of the present invention, a socket is described for a lighting system wherein the socket has a socket body and an electrical connector, and further includes protection for the lighting element such as a lamp. The protection may take the form of electrical insulation, thermal insulation, protection from vibration, contamination, and the like. In one form of the invention, the protection is provided by a cover for the conductor portion of the lamp. In another form of the invention, the protection is provided by a cover that extends over the conductive end of the lamp, and in still another form, the protection is provided by a seal between the socket and the lamp.

For example, in accordance with one preferred aspect of the present invention, a socket is described for a lighting system wherein the socket includes an element for forming a seal between the socket body and the lighting element. The seal can be formed from an O-ring or other suitable seal element. A seal can-provide protection from the effects of the environment, including humidity, temperature extremes, as well as particulate and other contamination. A seal can also protect the lighting system from the effects of vibration, impact, and other external forces. In one preferred form of the invention, the socket covers and seals a portion of the lamp, for example to provide thermal insulation to the electrode area of the lamp.

In another form of the invention, the contact includes a plurality of contacts in a base of the socket. For example, the contacts can be arranged in a diamond- or cross-configuration where two contacts accommodate the pins of one size of lamp, and wherein two other contacts accommodate the pins of a differently-sized lamp. Such an arrangement could accommodate a T-8 sized lamp, as well as a T-5 sized lamp, a T-8 and a T-10 or T-12, or any combination of known lamp configurations. The particular contact arrangement provides for the optimum isolation between adjacent contacts and between neutral and hot contacts.

In another form of the invention, the socket, such as the external surface of the socket body, may include one or more grooves or other elements for accepting a removable clip or mounting attachment, to mount the socket to a substrate or other support. In one embodiment, the groove would be approximately the same size as the mounting element at one end of the lamp, and larger than the corresponding dimension of the mounting element at the other end of the lamp. This arrangement permits expansion and contraction of the fixture relative to the fixed length of the lamp. Alignment indicators may also be included to indicate the desired lamp pin alignment relative to the socket.

In an additional form of the invention, a socket includes an electrical connector and a body extending longer than the contact length of the connector and wherein the connector or other portion of the socket includes a structure for engaging an insulator on the lamp. The structure may include barbs, points, or other elements for establishing an interference contact with the insulator. For example, connection between the lamp pins and socket can be achieved by a split sleeve slotted terminal made from spring material in the socket. The slotted terminal has an I.D. that is smaller than the O.D. of the male lamp pin, providing a pressure fit, which pressure fit provides a safeguard against accidental disconnection caused by vibration and the like. To further safeguard against such disconnection, two pointed barbs preferably extend outwardly from the external surface of the slotted terminal and engage the inner surface of counterbores of the lamp insulators. In addition, the socket's O-ring seal provides for a gripping of the exterior surface of the lamp which serves as added protection against disconnection.

In a further form of the invention, a socket is provided for a lighting assembly having a socket body and at least one electrical connector, and a holder for the socket body which is movable, at least rotatably or slidably, relative to the socket body, to permit expansion or contraction of the fixture assembly relative to the fixed lamp dimension. Preferably, the holder is removable from the socket. In another form of the invention, the holder is spring-biased and the mounting surface for mounting the holder to the substrate includes a track for adjusting the position of the holder relative to the socket.

In a further form of-the invention, an insulator is provided for such lighting elements as fluorescent lamps, wherein the insulator covers at least one of the conductors on the lamp and engages the conductor in such a way that removal of the insulator is inhibited. For example, with a bi-pin fluorescent lamp, the insulator may include two openings corresponding to the pins and dimensioned in such a way as to provide an interference fit between each pin and the opening in the insulator. In one preferred form of the invention, the height of the insulator is greater than or equal to the length of the pins to protect the pins. In another form, the insulator also covers a portion of the lamp body in order to help protect or insulate the lamp end.

These and other aspects of the present invention will be understood more fully after consideration of the drawings, a brief description of which is provided below, and the detailed description of the preferred embodiments.

III. BRIEF DESCRIPTIONS OF THE DRAWINGS

FIG. 2 is a cross sectional view of a socket in accordance with several aspects of the present invention.

FIG. 3 is a cross sectional view of an insulator taken through two of the bores of the insulator in accordance with a further aspect of the present invention.

FIG. 6 is a cross sectional view of a socket in accordance with further aspects of the present invention and including an end cap.

FIG. 7 is an end view of the sockets of the present invention without an end cap.

FIG. 12 is a side elevational view of a clip in accordance with one aspect of the present invention.

FIG. 13 is an end elevation view of a clip and mounting track in accordance with a further aspect of the present invention.

IV. DETAILED DESCRIPTION OF PREFERRED EMBODIMENTS OF THE INVENTION

A lighting system and components are described which minimize the possibility of electric shock, protect the socket and lamp connection from the environment and from vibration and other external forces, provide a more reliable connection between the socket and the lamp, and which are substantially independent of the particular lighting fixture mounting arrangement and allow for variances in lamp designs and dimensions. The lighting system and the components also accommodate such environmental elements as temperature extremes and moisture, and accommodate different lamp dimensions. The lighting system and components are also usable with current solid state ballasts.

Lighting systems and their components have numerous applications and the embodiments of the present inventions can be used advantageously in a variety of lighting systems. They find particular significance in the fluorescent lighting area, where there are particular needs met by the present inventions. The preferred embodiments described herein are intended to be illustrative of the inventions but the inventions are not limited to those embodiments. For example, some of the various embodiments are discussed with examples from the aspect of refrigeration units, especially as they relate to lighting systems in harsh environments. Refrigeration systems experience various extreme conditions such as very low temperatures, high humidity, significant vibration and high voltage and current conditions, and there are other situations where lighting systems are subject to such conditions as well. However, the present inventions are not limited to refrigeration applications. The inventions are discussed in more detail in their preferred embodiments below in conjunction with the drawings.

Figures 1, 5, 9, 10:
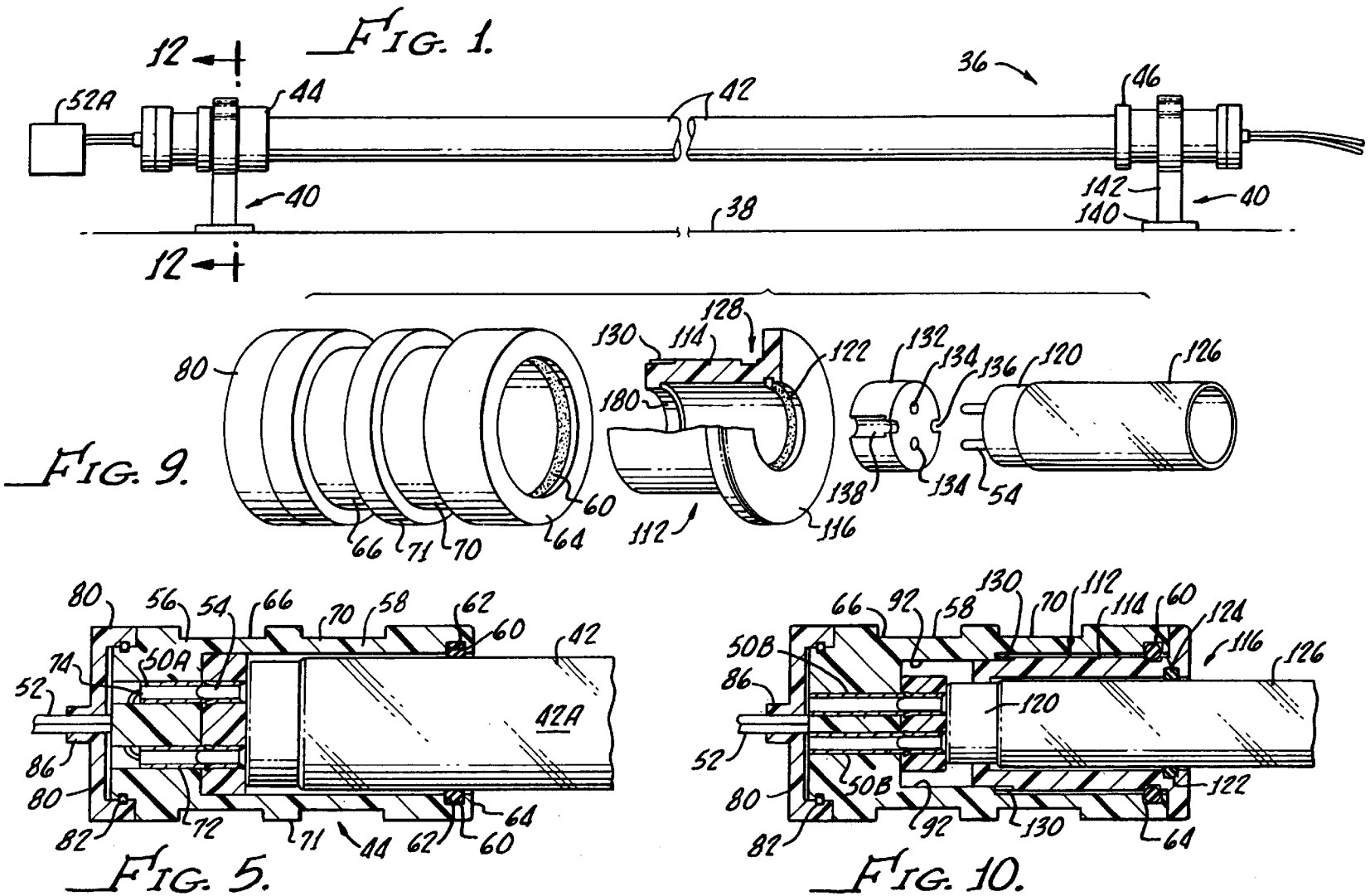
FIG. 1 is a side elevation view of a lighting assembly in accordance with one aspect of the present invention.
FIG. 5 is a longitudinal cross section of a socket and insulator in accordance with several aspects of the present invention.
FIG. 9 is an exploded perspective and partial sectional view of the socket, insulator and lamp of FIG. 10 in accordance with further aspects of the present invention.
FIG. 10 is a longitudinal cross sectional view of a socket in accordance with further aspects of the present invention.

A lighting assembly 36 is shown generally in FIG. 1, mounted to a base or substrate 38. In the context of a refrigeration unit, the support base 38 could be a mullion, frame element, wall or other structural support for supporting the lighting system. The lighting system can be mounted or supported at any orientation, including horizontally, vertically, or at an angle, and can be supported from any direction relative to the target of the illumination. The lighting system is mounted, attached, or otherwise supported by the support base 38 through mounting clips 40, several of which are shown in more detail in FIGS. 12 and 13, for mounting the sockets and lamp to the support base 38.

A lighting system typically includes a lighting element, which in the present preferred embodiment is a fluorescent lamp 42, and one or more connectors, which in the presently preferred embodiment includes a first socket 44 and a second socket 46. In the preferred embodiment, the first socket 44 is a fixed socket that would be placed on the bottom in a vertical lighting fixture arrangement, and the second socket 46 is an expansion socket mounted above the fixed socket 44. This same arrangement would preferably apply where the expansion socket 46 is mounted at a higher level than the fixed socket 44, though not necessarily exactly vertical, so that the fixed socket can reliably support the lamp and socket combination as desired.

The particular configuration of the lighting system shown in FIG. 1 corresponds to a combination which would accept lamps of two different lengths, and the configuration in FIG. 1 accommodates the longer of the two-lamps. The configuration is for the longer of two lamps because the mounting clip is mounted to the fixed socket 44 at a position closest to the lamp, as described more fully below.

Considering a preferred embodiment of the fixed socket in more detail relative to FIGS. 2, 4, 5, 9, and 10, the fixed socket 44 includes a rigid body 48, defining a bore, and further includes a plurality of conductive contacts or connectors 50 oriented preferrably parallel to the central axis of the socket for making contact with complementary connectors on the lamp 42. In the case of lighting fixtures using fluorescent lamps, the socket serves to connect and supply current from the ballast over conductors 52 through particular electrical connectors 50 through the two pins 54 of the lamp bulb to the lamp 42. The lamp typically includes the pins 54 mounted to but insulated from the end cap which in turn is mounted to the lamp body 42A. The socket is preferably substantially cylindrical in outside shape to minimize the space taken up by the socket in the lighting fixture. It is also substantially cylindrical in inside shape of the bore, except as noted below, to conform to the outer shape of the lamp 42. The cavity or enclosure defined by the body of the socket allows the necesary access by the lamp to the appropriate slotted contacts for energizing the lamp, and the body provides the desired protection for the socket and lamp connection. The body also protects users by minimizing the potential for shock from a failed or compromised socket connection.

The body of the socket is sized longitudinally so as to permit suitable mounting of the connectors 50 in the first wall or base 56 of the socket and to permit connection of the conductors 52 to the connectors 50 in the base of the socket. The body of the socket is preferably sized longitudinally so that the second or housing wall 58 defining the enclosure with the socket base 56 surrounds a portion of the lamp to provide preferably not only thermal insulation but also protection from other environmental effects such as moisture. Thermal insulation helps to maintain the lamp electrode temperature within a relatively limited range compared to the surrounding temperature. Moisture protection is preferred in order to protect the contacts and the other metallic portions of the lamp from corrosion and possible condensation or icing. The length of the wall 58 also helps to stabilize and support the lamp relative to the rest of the lighting assembly. The wall 58 of the socket also serves to cover not only the pins on the lamp, but also the base to which the pins are mounted. This protection helps to minimize the possibility of electrical shock due to open circuit voltage. Preferably, the housing wall is a unitary wall integral with the socket base 56 for providing structural integrity to the socket. The housing wall is at least twice the length of the connectors 50 extending from the socket base 56 so that they are recessed from the rim and to provide sufficient space for the socket to support the lamp. More particularly, the housing preferably extends sufficiently past the connectors 50 to cover the metal end cap of the lamp as well as the electrode area of a T-8 lamp, for example about one and five-eighths inches from the ends of the connectors 50 to the rim.

In one preferred embodiment of the invention, the socket includes a seal for forming a closed environment around the socket and lamp connection. The closed environment helps to thermally insulate the contacts and the socket-lamp connection. The seal also provides the desired protection against other environmental factors such as humidity and consequent icing or condensation of water on contact surfaces or surfaces around the connection between the socket and the lamp. The seal also has additional benefits such as structural integrity and helping to inhibit removal of the lamp from the socket under normal operating conditions. Moreover, the seal may also help to maintain linear stability to the socket lamp connection, and to keep the components centered. The seal is formed on the lamp where there is a reliable sealing surface, such as at the smooth glass surface of conventional fluorescent lamps.

The seal is preferrably provided in the form of an O-ring seal 60 for providing an air and moisture seal for the socket and lamp. The O-ring seal 60 is preferably placed in an O-ring groove 62 formed near the rim end face open end 64 of the socket. The O-ring and groove are sized to provide a good friction fit between the O-ring and the glass or other surface of the lamp, thereby providing the desired seal at that location. The seal provides structural support and inhibits lateral or longitudinal as well as rotational movement of the lamp within the socket. The O-ring seal helps to dampen or eliminate the effects of any vibration, impact or other external forces, thereby providing additional protection to the electrical contact between the lamp and the socket. The O-ring seal further helps to keep the components centered, especially as they are being assembled. The O-ring seal also helps to minimize the possibility of the socket and lamp separating longitudinally, which helps to maintain the proper electrical connection between the socket and the lamp. Consequently, the O-ring seal also helps to minimize the possibility of arcing, exposure to open circuit voltages, and high potentials in the socket.

In the preferred embodiment, the O-ring is seated in its O-ring groove on the inside of the socket and extends sufficiently out into the bore to form the good mechanical seal. Alternatively, the O-ring seal may also be positioned intermediate or part way along the interior surface of the bore of the socket and still provide a moisture, thermal and environmental seal for the electrodes and the end face of the lamp. However, thermal insulation of the electrodes might be reduced and the potential for contamination by particles or other elements could occur between an intermediate O-ring seal and the end face 64 of the socket.

Figures 4, 8, 11:
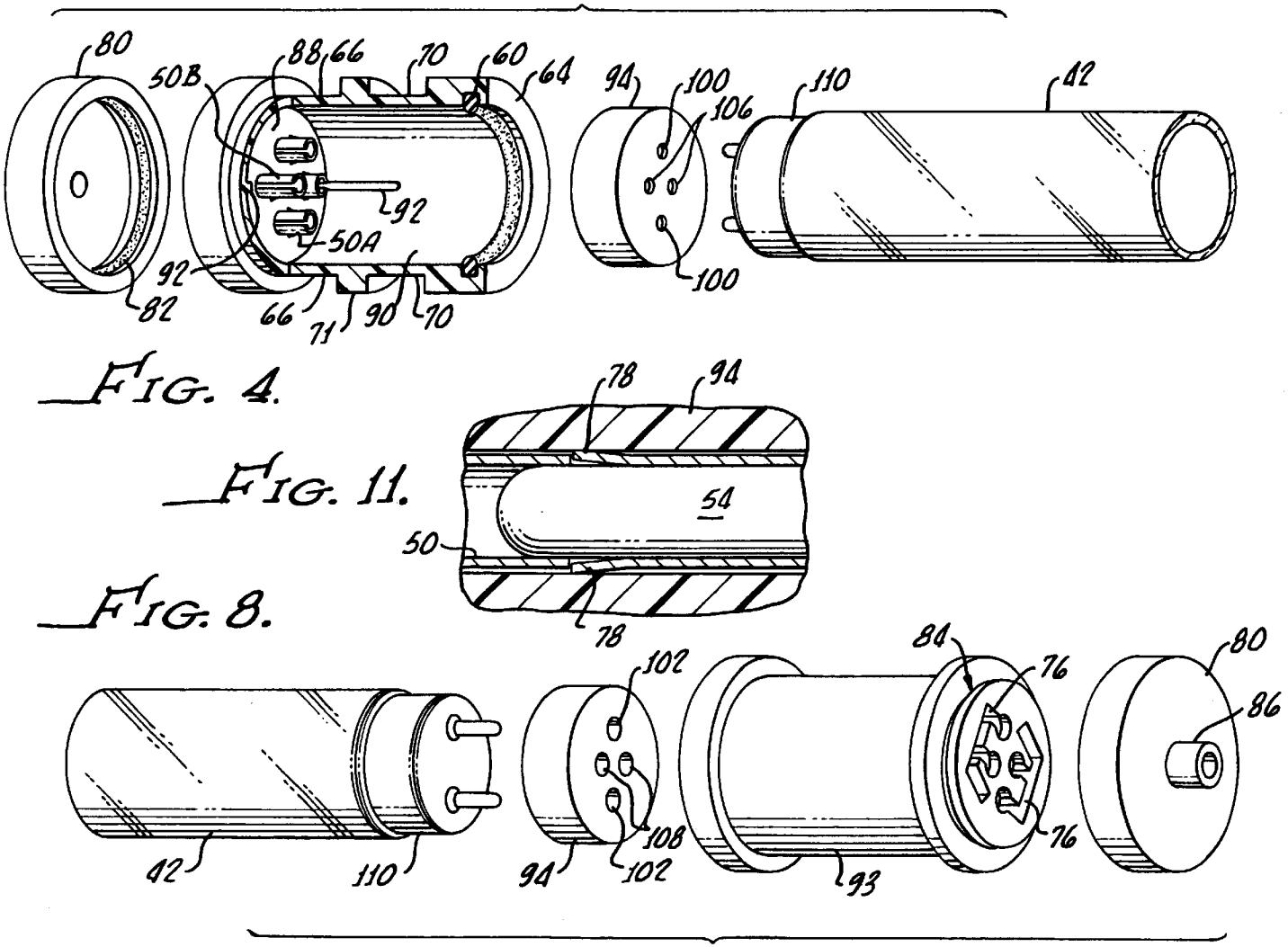
FIG. 4 is an exploded perspective and partial cross sectional view of a socket, insulator and lamp in accordance with several aspects of the present invention.
FIG. 8 is an exploded perspective view of another form of socket with a lamp and insulator in accordance with several aspects of the present invention.
FIG. 11 is a detail cross sectional view of an electrical connection may with the socket and lamp and insulator in accordance with further aspects of the present invention.
Figure 14:
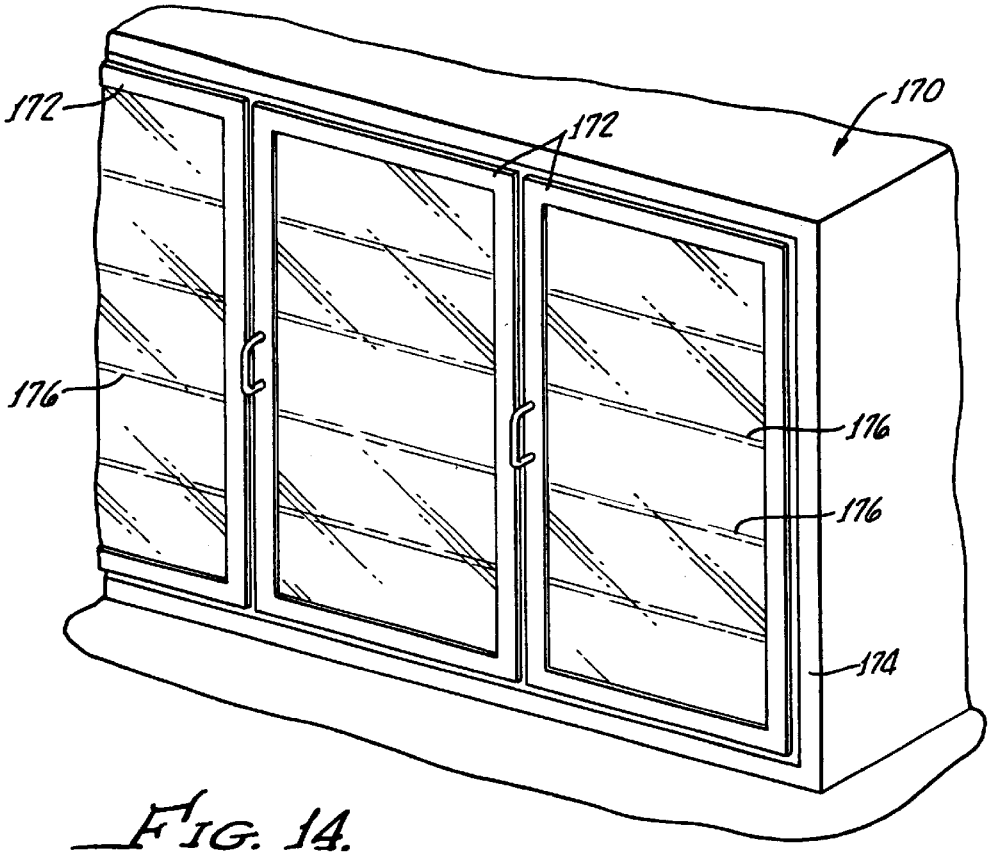
FIG. 14 is perspective view of a refrigeration case as one example of an application for a lighting system of the present invention, and one which is subject to environmental extremes and vibration and other effects.

Considering the fixed socket 44 in more detail, particularly with respect to FIGS. 4 and 5, the socket includes a first mounting or support groove 66 for releasably accepting an attachment arm or engagement portion 68 of a holder, support or mounting device such as clip 40 (FIGS. 1 and 12). The first mounting groove 66 preferably extends around the entire perimeter of the fixed socket 44, and is preferably only slightly wider than the longitudinal length of the engagement portion 68 of the clip. This spacing permits suitable engagement of the clip with the fixed socket and permits rotation of the socket within the clip, but minimizes the amount of longitudinal motion of the socket relative to the clip. While longitudinal motion of the socket relative to the clip is possible, it is preferred that there be relatively little longitudinal motion so that the lamp can be reliably positioned relative to the support base 38.

The fixed socket also preferably includes a second mounting groove 70 similar to the first mounting groove 66 but positioned between the first mounting groove 66 and the open end 64 of the socket. The second mounting groove 70,is separated from the first mounting groove 66 by a ridge 71. The second mounting groove 70 has the same structure and function as the first mounting groove 66, but gives more flexibility in positioning the lamp and socket assembly. The second groove is preferably used to suitably position the sockets with a longer lamp than is used in positioning a lamp using the first mounting groove 66. For a given clip spacing, mounting a lamp using the second mounting groove 70 places the electrical connectors 50 further away from the clip and contacts on the expansion socket 46 to accommodate a longer lamp. For example, the second mounting groove 70 can be used to position a T-8 lamp while the first mounting groove 66 can be used to position the approximately two inch shorter T-5 lamp. Because the T-5 lamp is slightly shorter than a T-8 lamp, the sockets are positioned closer together than sockets for mounting a T-8 lamp.

The base 56 of the socket includes bores 72 for accepting respective split connectors 50. The connectors 50 are positioned spaced apart in the base at points of an elongated diamond, cross or "X" to accommodate the bi-pins of a T-8 lamp in one configuration and the bi-pins of a T-5 lamp in the other configuration. The pair of connectors 50 for a T-8 lamp are designated 50A and are shown most clearly in FIG. 5 connecting to the pins 54 of a T-8 lamp. The spacing about the center of the base between the connectors 50A represents the pin spacing found in a T-8 lamp. The pair of connectors 50 for a T-5 lamp are designated 50B, seen most clearly in FIG. 10, representing the pin spacing for a T-5 lamp. The socket 44 of FIG. 4 is shown in one orientation in FIG. 5 and is shown rotated 90 degrees in FIG. 10. While the orientation is preferably 90 degrees, other relative orientations are possible, such as being 80 degrees apart but still preferably being on lines intersecting at the center of the base. Other pin orientations are especially possible with pin spacings that are significantly different. Opposite connectors in a pair are the neutral and hot connectors for a given lamp. As shown in FIG. 5, one connector in each pair is coupled to respective hot and neutral conductors designated generically as 74 in respective wire ways designated generally as 76 (FIG. 7) for providing current from the conductors 52 to the connectors 50. Similar or related connector configurations can be used to accomodate other pin configurations for other lamp sizes and configurations.

The connectors are preferably hollow or cylindrical connectors, preferrably compression type or slotted, and may have a cross section in the shape of a triangle, square, rectangle or other suitable shape, and some are conventionally referred to as female connectors. The connectors will be referred to herein as cylindrical connectors, which term is intended to include these connectors as well as others having the characteristics described, such as enclosing a pin-type connector for producing a relatively high contact surface area. The cylindrical connectors are press fit into like-sized bores in the base 56 in their appropriate positions with the conductors 74 soldered or otherwise coupled to the both (one conductor for the two hot connectors and one conductor for the two neutral connectors) of their respective connectors for passing current to the connectors.

The connectors 50 preferably include one or more barbs 78 to minimize the possibility of removal of the connectors from the socket base 56, and also to engage insulators on the lamps, as described more fully below with respect to FIG. 11. The connectors 50 have a length which will fully seat the pins 54 on the lamps sufficiently to provide the desired electrical connection. They have a diameter which will provide a good wiping electrical connection with the pins from the lamp when the socket is placed on the lamp. The combination of a split connector with a pin contact from the lamp enhances the surface area of electrical contact, possibly even by as much as four times, and decreases the current density for a given current level, relative to other sockets.

The length of the housing beyond the connectors is preferably sufficient to provide protection for users and to provide protection to the lamp-socket connection. The connector ends should be sufficiently recessed in the housing from the rim to minimize the possibility of personnel touching a live contact. This added length on the socket should be balanced with the desire for maximum light exposure from the lamp, minimizing the amount of usable lamp space that is covered. Additionally, the socket housing is preferably long enough to firmly engage the lamp and form a reliable seal between the socket and the lamp with the O-ring. Therefore, the socket housing is preferably long enough for the O-ring seal to contact a portion of the lamp surface that is uniform, i.e. not transitioning from the body of the lamp to the metal end cap. The longer the housing, the more stable is the socket-lamp connection. Additionally, with a longer housing, additional O-ring seals may be provided if desired.

The end of the socket is preferably sealed with a socket end cap 80, which may include an O-ring seal 82 positioned in an O-ring groove in the end cap 80 to provide a suitable seal between the end cap 80 and a groove 84 in the end of the socket. The conductors 52 then pass through the end cap through a seal and strain relief 86. Preferably, a moisture and air-tight seal is provided by suitable means in the strain relief 86, such as by molding the cap and strain relief about the conductors. Alternatively to the O-ring 82, the end cap can be sealed and bonded to the body of the socket through ultrasonic welding or other suitable means. The wires may be attached to the socket at any desired entry point, from the end of the socket, the side, or the like.

The connectors 50 extend through and beyond the housing base surface or base wall 88 a distance sufficient to accommodate the insulator for the lamp bulbs, described more fully below. The base wall 88 forms the end or bottom of the cylindrical housing wall 58 of the socket, opposite the open end 64. The housing wall 58 preferably includes a relatively smooth interior surface wall 90 (except as noted below) between the O-ring groove 62 and the base wall 88 to minimize the possibility that insertion of the lamp into the bore of the socket causes any hang up or obstruction. In the preferred embodiment, key surfaces 92 (FIGS. 4 and 10) are formed 180 degrees apart extending longitudinally along the inside surface 90 of the socket from the base wall 88 part way toward the open end 64. They are preferrably coplanar with one set of connectors 50 to indicate their location, in the present case those for the T-5 lamp (see FIGS. 4 and 10). These key surfaces 92 engage and position a lamp adapter, described more fully below. The key surfaces also may be used to help properly position the lamps so that the bi-pins of each lamp end properly engage-the appropriate connectors 50 at the base of the socket. Where key surfaces are used, the insulators would also include key ways in order to match the key surfaces formed in the bore of the socket. Key ways are not shown in the insulators (described more fully below) but it should be understood that they would be included where key surfaces are used for alignment or for engagement of parts.

The expansion socket 46, shown in more detail in FIG. 8, accommodates contraction and expansion of the support base 38 due to environmental factors as well as accommodates differences in the tolerances of various components and also variations in mounting arrangements for the clips 40. The expansion socket assists in providing a lamp and socket assembly having electrical connections that are relatively independent of the particular mounting arrangement used to support the lamp. The expansion socket 46 is essentially identical to the fixed socket 44 except that first and second mounting grooves 66 and 70, respectively, are replaced by a continuous groove 93 and undivided by any ridge 71. The socket is supported by the clip 40 in such a manner that the expansion socket 46 can still rotate within the clip and also move longitudinally relative to the clip to accomodate expansion and contraction and other effects such as vibration. Aside from the fixed and expansion sockets having different mounting grooves, they are otherwise identical in the preferred embodiment.

Other alternatives are available for attaching the conductors 52 to the socket. For example, the socket can include clips similar to those on tombstone-style sockets for accepting and holding solid wire conductors. These clips are then electrically coupled to the slotted connectors 50. Another alternative includes conductors 52 terminating in a connector 52A (FIG. 1), such as a Molex connector, for connecting the conductors 52 to a mating Molex or other connector from the ballast. Alternatively, the conductors 52 can be connected to the socket through a plug mounted or imbedded in the socket. For example, the plug could be a Molex-type connector in the socket.

Other alternatives are available for supporting the socket and lamp. For example, the socket can have slots or grooves extending longitudinally along the surface of the body to allow movement of the socket during expansion or contraction, for example. While slots might limit full rotational movement of the socket, the expansion and contraction resulting from environmental conditions occurs most noticably in the longitudinal direction. Slots in a socket would still permit longitudinal movement.

The sockets described herein provide for an independent means of supporting and providing electrical connection for the lamp. The sockets are rotatably and/or longitudinally movable relative to the base or substrate to which the lamp and socket assembly is mounted, and they could be movable in other directions as well, while still maintaining the desired electrical connection and the desired protection for the connection. This permits the socket and the electrical connection to move relatively to the mounting substrate so that the socket becomes more a part of the bulb than the mounting structure. The socket also provides for universal positioning of the lamp independent of the lamp length or the center-to-center distances of the sockets. The sockets also provide for lower labor and material costs and permit easier installation and repair and replacement of lighting elements. The light arrangements can be mounted in any physical orientation and can accommodate a number or variety of support hardware, such as clips, hangars and the like. The sockets permit variants in pin alignment, lamp length, pin length and differences in other lighting element features. The sockets described also provide for linear socket and pin electrical contact and for a larger surface area of electrical contact than has existed in some other pre-existing designs.

The sockets described herein also provide protection from the environment such as moisture, especially in cold environments where moisture may condense or freeze on the connection between the lamp and the socket by providing a closed environment about the electrical connection. The socket also provides thermal insulation for improving the efficiency of the operation of the lamp or other lighting element, and reduces the impact of vibration and other mechanical forces. The socket floats with expansion and contraction of the substrate or base material, thereby reducing the effects of bending or canting occurring in conventional socket designs. The sockets also maximize electrical connection between lamp pins and socket connectors, provide mechanical support for the lamp. They also may include indicators, keys, or other signs to assist in assembling and connecting the various components of the lighting system. The sockets are usable with newer ballasts, lamps, and the like, especially those having higher voltages, frequencies and currents.

A lighting element, in the preferred embodiment shown as a longitudinally extending fluorescent lamp, preferably includes insulators 94 (FIGS. 4, 5, 8 and 10) insulating the conductive pins to minimize the possibility of electric shock if the conductive pins are live. If one end of a lamp is connected to a live wire, the other end could be charged, resulting in electric shock, injury or damage, if the other end comes into contact with a person or hardware. The insulator 94 is intended to minimize the possibility of electric shock or damage. The insulator may also protect the contact pins from the environment and from damage to the contact pins during handling and shipment of the lamps.

In the preferred embodiment, an insulator covers each end of the lamp as well as the conductors on each end. In this way, the pin conductors are recessed in the insulator and so that they are inaccessible except through an appropriate connection, such as that shown in the sockets with the slotted connectors described herein. The insulator is also preferably formed so as to provide an interference fit with the pins on the lamps to inhibit removal of the insulator from the lamp.

The insulator 94 (FIGS. 3, 4, and 8) includes an insulator top surface 96 and an insulator bottom surface 98 to match the relatively flat surface of the lamp end. The height or thickness of the insulator is preferably large enough to cover and recess the lamp pins below the surface of the insulator by at least a sixteenth of an inch. The insulator is preferably cylindrical in cross section to match the outer configuration of the lamp to which it will be attached. The desired diameter of the insulator depends on the particular design and the relative dimensions of the O-ring and the other components forming the socket and lamp combination. The diameter of the insulator is preferably large enough to suitably align the lamp as it is being inserted in the socket, but still permit withdrawal of the lamp with the insulator past the O-ring during lamp exchange without leaving the insulator behind in the bore of the socket. Preferably it is about the same diameter as the metal end cap for the lamp.

The insulator 94 shown in FIGS. 3, 4, and 8 is a configuration intended to be used with a T-8 lamp and to be used with sockets suitable for T-8 and T-5 lamps. However, other configurations are possible to accommodate other lamp configurations. The insulator need not be a dual lamp design. The insulator includes first bores 100 extending entirely through the insulator from the top surface 96 to the bottom surface 98. The diameter of the first bores 100 are preferably less than the outside diameter of the pins on the T-8 lamps, and preferably by an amount sufficient to make it difficult to remove the insulator under normal conditions without some effort. For example, for a pin outside diameter on the T-8 lamps of 0.090 inches, the inside diameter of the first bores 100 are preferably approximately 0.076 inches or of a sufficient diameter to ensure a reliable interference fit between the insulator and the lamp. The reduced diameter insures an interference fit between the pins and the insulator to inhibit removal of the insulator from the lamp, and to insure that the pins remain recessed in the insulator and protected from environmental conditions.

The insulator 94 further includes first counter bores 102 (FIGS. 3 and 8) extending almost the entire length of the insulator but not entirely, leaving sufficient material to form a membrane 104 (FIG. 3) which serves to grasp the pins on the lamp. The first counter bores 102 are dimensioned so as to provide sufficient clearance for the slotted connectors 50 when the socket is placed over the lamp while still providing an interference fit sufficient to push the barbs into the insulator material.

The insulator, when used with a socket which accommodates two different sized lamps, may have second bores 106 and second counter bores 108 (FIGS. 3 and 8) providing clearance for inserting the insulator into the socket having four slotted connectors 50. The second counter bores 108 will fit over the slotted connectors 50 included in the preferred embodiment for the T-5 lamp so that the slotted connectors 50 for the T-8 lamp can engage the pins on the T-8 lamp. It should be understood that the second bores 106 need not be formed all the way through the insulator, but may be a blind hole terminating at the membrane, since there are no corresponding pins or projections on the T-8 lamp which they need to accommodate. The blind holes would have the same diameter as the second counter bores 108, and would be substituted for the second counter bores 108 to accept the connectors 50B that will not be used when a T-8 lamp is in place. Similar configurations can be incorporated into an insulator so that the lamp can be used with a socket that accomodates other lamps, such as T-10 and T-12 lamps.

In the preferred embodiment, the T-8 insulator fits down flush against the end face of the T-8 lamp, as shown in FIG. 5. Preferably, the membrane 104 fits down over and around the flared base of each pin 54. Additionally, if the socket did not extend over the neck or the glass portions of the lamp, the insulator 94 could include a skirt (not shown) which defines a bore into which the neck portion 110 of the T-8 lamp fits into. A skirt on the insulator would fit over the neck portion and could also fit over a portion of the glass surface of the lamp to provide thermal insulation and further electrical isolation of the end of the lamp. The skirt could extend over the glass portion of the lamp to further insulate the end of the lamp, such as for insulating the electrode portions of the lamp. Such a skirt would enhance the operating efficiency of the lamp by thermally insulating the electrodes and keeping the electrodes within a narrower temperature range. If a skirt were included on the insulator extending over a part of the glass of the lamp and the socket were to be coextensive with the skirt, some dimensional changes would be made in adjacent parts of the socket to accommodate the larger outside diameter of the insulator.

The insulator or cover reduces or eliminates the possibility of shock due to a failed or compromised connection by providing means for protecting personnel and equipment from electric shocks in case the contacts happen to become live. The insulator or cover may accomplish one or more of the following: Recess the contact pins of a lamp, cover the contacts as well as the end face of the lamp, cover and/or protect the ends of the lamp, provide structural support for the lamp end, provide thermal insulation for the electrode area of the lamp, and provide a moisture barrier for the lamp ends. One or-more of these elements provide thermal and other environmental protection, mechanical and electrical protection for the lamp as well as structural support for the lamp. The insulator or cover may also provide electrical connection for bare wires, a connector such as a Molex connector, or simply provide an interface for a separate socket. Where the insulator or cover provides the primary structural support and enclosure for the lamp end, the insulator or cover may also provide the means for mounting a clip or other support, for supporting the lamp end.

In the preferred embodiment, the insulator 94 is placed over the ends of the fluorescent lamps prior to shipment. The lamps are then installed on a new or pre-existing fixture having the sockets described herein by removing the sockets from their respective clips. The lamp and insulator are then aligned with a socket, such as by sight or by aligning a mark on the lamp with a suitable indicator mark on the socket so that the pins 54 of the lamp will engage the appropriate slotted connectors 50 in the socket for the particular lamp. The lamp and insulator are then inserted into the bore of the socket past the O-ring seal 60 until the slotted connectors engage the pins 54 and the internal surfaces of the first counter bores 102. The lamp is inserted further into the socket so that the slotted connectors 50 slide over the pins 54, ensuring suitable electrical conduction through a wiping action. When the lamp is fully inserted into the socket, the top surface 96 of the insulator abuts against the base wall 88 of the socket, the pins 54 are fully seated in the slotted connectors 50 and the O-ring seal 60 is slightly compressed to form a suitable seal completely around the glass or other surface of the lamp 42 as part of a closed environment defined by the socket. This procedure is followed for both the fixed socket 44 and the expansion socket 46, after which the two sockets are engaged with the clips 40, which have been suitably positioned on the support base 38 so the lamp and socket assembly can be supported on the support base 38.

After assembly, the fixed socket 44 (FIG. 5) and the expansion socket 46 (FIG. 8) form a socket and lamp combination wherein the insulator covers the end of the lamp and the conductive pins in such a way that they inhibit the removal of the insulator from the lamp. The socket has a socket body 48 including electrical connectors 50 for contacting the conductors on the lamp. The socket body preferably extends beyond the pins on the lamp to provide thermal and environmental protection for the lamp and for the lamp-socket connection. Also in the preferred embodiment, the socket provides moisture and thermal protection for the lamp, such as through the O-ring seal 60, and also provides protection against vibration and other impact forces. In the embodiment shown in FIGS. 4, 5 and 8, the socket and the O-ring seal provide structural support for the lamp as well. The support grooves. 66, 70 and 93 provide expansion, and contraction support for the socket and lamp assembly, particularly where the support base 38 may undergo significant contractions and expansion due to environmental effects. For example, for a 72-inch lamp, the support base 38 may contract or expand several eighths of an inch between the clips holding the socket and lamp assembly, causing conventional sockets to bend and possibly break or compromise the connection between the lamp and socket in such a way that a high open circuit voltage could exist or cause arcing or overheating of the lamp or socket. Any expansion or contraction in the lighting assembly shown in FIG. 1 is accommodated by the expansion socket 46 and the relatively long groove 93 engaged by the clip 40. The fixed socket is preferably positioned in such a way to permit the foreseeable contraction as well as expansion by positioning the clip holding the expansion socket in such a way as to permit both contraction and expansion. The grooves also help to absorb some of the effects of vibration. The O-ring seal and the socket also help to minimize any relative movement between the lamp and the socket.

The lamp and insulator assembly as well as the lamp and socket assembly provide enhanced safety for personnel, customers, and technicians, and is more compatible with electronic ballasts. The assembly is relatively unaffected by longitudinal dimensional changes or variations either in installation, assembly or during operation, maintaining an improved connection between the conductors and the lamp. The assembly is less likely to be affected by contamination accompanying cleaning, moisture from humidity or other environmental elements and temperature changes. The sockets can be mounted on either one or both ends, but it is conceivable that a traditional socket can be used on one end of the lamp while using the expansion socket, for example, on the other end. In many respects, the socket can be considered as part of the lamp, with very little movement, if any, between the socket and lamp under many circumstances. Depending on the methods of attachment of the clips to the base, universal positioning of lamps of many sizes and configurations can be accommodated with the socket and lamp arrangement of the present invention. This assembly can accommodate different center-to-center distances. The design also permits lower labor and material costs and easier repair and replacement less prone to error or damage. The positioning of the sockets need not be on a fixed center dictated by the lamp length, and the sockets can use clips, hangers, or other mounting elements for positioning the sockets on the lamps and supporting them on an appropriate base structure. The sockets also allow for variances in pin alignment or lamp length while providing good electrical contact between the lamp pins and the slotted connectors in the socket. The electrical contact is preferably created by linear sliding contact and pin connection, producing, after complete connection, a good peripheral contact around the pins. Additionally, the use of the linear connection arrangement between the lamp pins and the slotted connectors provides for greater surface area of electrical contact, thereby reducing the current density flowing between the connectors and the lamp pins. Therefore, for longer lamps and higher lamp currents, the connection is less subject to overheating, failure or other effects because of the higher current. The sockets can also accommodate different sized lamps, such as T-8, T-5 and T3 lamps, as described more fully below, and the same features described with respect to the sockets can be used to make a socket that can accommodate both T-10 and T-8 sized lamps, T-10 and T-12 sized lamps, or other combinations of lamp sizes and features. Additionally, the use of the insulators minimizes the possibility of an exposed hot lamp contact, even if the other end of the lamp is connected to a live socket. This minimizes the possibility of electrical shock due to high open circuit voltage.

In an alternative embodiment, the insulator 94 can include metal or other spring-type disks or plates embedded in the membrane 104 to inhibit withdrawal of the insulator from the lamp. The plates include circular walls extending into the first bores 100 in order to contact the lamp pins as they extend into the first counter bores 102. The plates or disks are preferably separated and unconnected as to each other to ensure that no short occurs between the two pins on the lamp. The disks are intended to bite into the metal of the pins as the pins are inserted through the openings in the disks. The inside diameter of the openings in the disks are preferably smaller than the outside diameter of the pins on the lamps so that the material of the disks flare upwardly in the direction of the insertion of the pins. The flared portions will then bite into the material of the pins and substantially inhibit removal of the insulator 94 from the lamp. In one preferred embodiment, each disk in the insulator fully encircles the first bore 100. Alternatively, each plate could be a semi-circle or square plate positioned at the outer side of each first bore 100 so that the two plates are spaced as far apart from each other as possible, thereby minimizing any possible shorting between the two plates. The plates could be included in the membranes during molding or other production of the insulator.

The insulator is preferably formed from a suitable plastic insulating material with sufficient structural integrity to withstand the environmental conditions experienced in such lighting fixtures and to withstand the currents-and voltages occurring in these fixtures. The sockets are preferably formed from suitable plastics or other materials currently found in conventional sockets, for example those for fluorescent lamps. For example, rigid thermoplastics are preferred for the socket material for the body, particularly for ensuring the strength, dielectric strength and mechanical integrity of the socket and that would take advantage of properties of conventional thermoplastics suitable for socket design. Preferably, the socket is made from a material as rigid as conventional sockets, such as phenolics and urea and engineering thermoplastics capable of withstanding high temperatures, such as for example 600 or 700 degrees F. The O-rings are preferably selected from a suitable material able to withstand the temperature extremes found in these lighting systems, for example, silicone or Teflon O-rings are available that withstand very wide temperature extremes.

Key ways may also be used, if desired, to assist in inserting the lamp and insulator into the sockets. For example, the internal surface of the wall of the socket can include a key surface and the insulator can include a key groove for mating the insertion of the lamp and insulator within the socket. Indicator marks or lines can also be included on the socket to facilitate proper joinder of the socket and the lamp.

The fixed socket 44 and the expansion socket 46 can accommodate different sized lamps, such as a T-5 lamp in addition to a T-8 lamp. As shown in FIGS. 9 and 10, the fixed socket accepts an adapter having a cylindrical sleeve 114 and a flanged rim 116 for engaging and seating in the bore of the fixed socket 44. The sleeve includes an inwardly extending rim 118 for guiding and supporting the neck 120 of a T-5 lamp (FIGS. 9 and 10). A seal and tight fit are formed on the internal surface of the rim 116, through an O-ring 122, which extends within an O-ring groove 124 to provide support and a seal for the T-5 lamp 126. The sleeve 114 and the O-ring seal 122 have functions similar to the housing wall 58 and O-ring seal 60 relative to the T-8 lamp 42 described with respect to FIG. 5. The adapter 112 is reliably held in place by the O-ring seal 60 compressed between the O-ring groove 62 and a complimentary O-ring groove 128 formed in the outer surface of the sleeve 114, below the rim 116.

The adapter 112 also includes one or more key ways 130 for engaging the key surfaces 92 on the inside surface of the bore in the socket. The key ways 130 and the key surfaces 92 ensure proper orientation of the pins on the T-5 lamp with the appropriate slotted connectors in the socket. The appropriate slotted connectors in the socket are the second set of two slotted connectors different than the first set of slotted connectors used by the pins on the T-8 lamp. The slotted connectors for the T-5 lamp are closer together and have a smaller center-to-center distance than the spacing of the slotted connectors for the T-8 lamp.

The T-5 lamp 126 (FIGS. 9 and 10) is combined with a T-5 insulator 132 having a pair of first bores 134 for sliding over and engaging the corresponding pins on the end of the T-5 lamp. The internal diameter of the first bore is preferably approximately 0.076 inches for an approximately 0.090 inch pin diameter to ensure a good friction fit. The T-5 insulator 132 also includes first counter bores coaxial with the first bores 134 having similar internal diameters and lengths relative to the counter bores in the T-8 insulator top surface 96. The counter bores are formed to accommodate the diameter of the slotted connectors in the socket.

The T-5 insulator 132 also includes second grooves 136 and second counter grooves 138 to accommodate the slotted connectors corresponding to the T-8 lamp connection. The second grooves 136 and second counter grooves 138 are included to permit the T-5 lamp 126 and T-5 lamp insulator 132 to engage the socket without having the slotted connectors corresponding to the T-8 lamps interfere with the connection between the T-5 slotted connectors and the T-5 pins during seating of the lamp in the socket. The second grooves 136 can be omitted entirely because there is no corresponding pin that will extend along the groove. The dimensions and spacing of the first bores and first counter bores 134 in the T-5 insulator are substantially the same as the second bores 106 and second counter bores 108 in the T-8 lamp insulator top surface 96. The same comments apply with respect to the grooves 136 and 138 relative to the bores 100 and 102 in the T-8 insulator. The overall outside diameter of the T-5 insulator 132 is smaller to permit insertion of the insulator and T-5 lamp into the adapter 112 to be sealed by the O-ring 122 and to engage the socket as shown in FIG. 10.

The adapter for the T-5 lamp can be replaced by the T-8 insulator, attached to the T-5 lamp to insulate and protect the pins and end of the lamp. The T-8 insulator and T-5 lamp can then be inserted into the socket and connection made. While the O-ring would not be contacting the lamp and therefore sealing the interior of the socket, the T-5 lamp would still have an insulator that would minimize the possibility of open circuit voltage shock and would still permit connection of the T-5 lamp to the socket. The other benefits of using the insulator and sockets with a T-5 lamp would then be achieved.

Other key way or indicator arrangements may be provided for minimizing any possibility of mismatch between two different lamp designs or two different lighting arrangements. For example, alternative embodiments could include a key mechanism between the internal surface of the socket bore and the outside surface of the T-8 lamp pin insulator. Additionally, a similar key arrangement could be provided as described above for the T-5 adapter when it is inserted in the bore of the socket. An additional key arrangement can be provided between the insulator for the T-5 lamp and the T-5 adapter to ensure the reliability of the fit between the T-5 adapter and the lamp. An indicator or key can also be provided on the outside of the T-5 adapter so that the pins of the T-5 lamp can be properly positioned in the socket so that proper electrical connection can be made. For example, an indicator can be placed around the perimeter of the rim 116 on the T-5 adapter to match up with an indicator on the end face 64 of the socket.

In the preferred embodiment, the engagement of a lamp pin 54 with a slotted connector 50 expands the diameter of the slotted connector 50 so that the barbs 78 press into and engage the wall of the insulator 94. (See FIG. 11). The engagement of the barbs with the insulator wall enhances the integrity of the electrical connection and the lamp-socket connection. The barbs inhibit the withdrawal of the slotted connector from the insulator, and therefore inhibit disconnection of the lamp from the socket. The combination of the barbs and the interference fit between the insulators and the lamp pins provide a further obstacle to disconnecting the lamp from the socket. The barbs inhibit removal of the lamp and insulator from the socket, the wiping action of the pins and the slot connectors inhibit removal of the pins from the slot connectors, and the interference fit inhibits movement between the pins and the insulator. Overall, the use and the dimensions of the insulator, pins and connectors and the use of the barbs all combine to make disconnection more difficult. Moreover, the lateral support provided to the electrical connection by the socket and lamp engagement, and the longitudinal support provided by the pins, split connectors, barbs and the insulator and the O-ring seal all contribute to a stable connection that is more difficult to break or compromise.

It should be noted that other configurations of a lamp insulator and socket are possible. For example, the insulator may be included with a sleeve and an O-ring seal extending over a portion of the glass or other body portion of the lamp to provide the environmental seal for the pins and contact portion of the lamp. Preferably, the lamp pin contacts are still recessed within an insulator to minimize the possibility of electric shock from live contact, for example where the other end is connected to a live socket. A socket having slotted connectors can then be coupled to the insulator portion engaging the contact pins of the lamp, while preferably also forming a moisture seal between the socket and the body of the insulator. For example, the seal can be formed by an O-ring seal or an interference fit between plastic surfaces on the insulator portion and on the mating socket portion. Larger component diameters for the socket and/or insulator may be necessary in a configuration such as that just described.

In another alternative to the insulator and socket arrangement, the insulator may cover the end face and a portion of the sides of the lamp to provide the thermal and moisture barrier described above, while also including a transmission or interface connector between the pins and a socket on the insulator for accepting a mating plug from the conductors 52. In another form of an insulator for example where it could cover at least the end of the lamp, the insulator could include an electrical connection socket, clamp or receptacle to which is attached the solid wires that are typically used in many lighting systems. With such an arrangement, the lamp can be assembled with the combined insulator receptacle and sold, shipped, and thereafter installed as a unit by simply connecting the solid wires to the appropriate receptacles. This is not as desirable as other configurations because change out of the lamp would require removal of the exposed wires from the receptacles, leaving exposed wires.

Considering the clips 40 in more detail, the clip includes a mounting surface or clip base 140 for being supported by, engaging or mounting to the support base 38. The clip further includes a web or bridge 142 extending from the clip base 140 to the socket engagement arms 68 so that the lamp and sockets can be supported spaced from the support base 38 while still permitting longitudinal and/or rotational movement of the sockets and lamp together. The bridge 142 can be jointed or rotatable relative to the clip base 140 so that the lamp orientation can be set independent of the positioning of the clip support base 140 on the base 38. The clip 40 also preferably includes wings 144 at the terminal ends of the attachment arms 68 to permit grasping and spreading, of the arms 68 for insertion or removal of the lamp and socket assembly. The clip 40 shown in FIG. 12 can be formed from any suitable material capable of resiliently holding a lamp and socket assembly while still allowing rotational and/or longitudinal movement of the socket/lamp in the environment intended for the lighting system. For example, the material could be a thermoplastic or a metal sufficiently strong but resilient to releasably support the sockets and lamp and other hardware that might be included.

The clip 40 can be mounted to the support base 38 in a track such as that shown in FIG. 13, and held in position by suitable clips, fasteners, or blocks to limit movement of the clip within the track during normal operations. Positioning of the clip 40 and the track 146 permits essentially universal adjustment of the clip 40 relative to the support base 38 to accommodate different lamp lengths and also to more closely position the light source relative to the item or items being illuminated. The track 146 in a preferred embodiment is a longitudinally extending track mounted to the support base 38 and preferably extending in a direction parallel to the direction that the lamp extends. The track can be continuous to run the entire length of the lamp, plus some additional distance for adjustment, or segmented to have two units, a first one for supporting one clip, and a second one to support the other clip. Positioning of the clips in a longitudinally extending track permits almost universal positioning and variation in position of the clips 40. Alternatively, clips 40 can be mounted in one of a plurality of transversely extending tracks (not shown), whose length in the transverse direction is approximately the same as the width of the clip base 140 as shown in FIG. 12. This would allow the clip to be removed laterally along the track and repositioned into an adjacent or other like-oriented track spaced in one direction or another from the original track. The clip would then be moved laterally along the new track and centered on the support base 38 so that the clips are again realigned to properly position the socket and lamp assembly. Such a track arrangement would provide for more discrete rather than continuous positioning of the clips.

In a further embodiment of the clip and track combination, FIG. 13, the track 146 preferably extends longitudinally in the same direction as the lamp. The clip 150 is preferably formed from a resilient, relatively strong material such as spring steel and biased in such a way that the base portion 152 engages the track 146 when the lamp and socket assembly are held in place in such a way that the clip 150 remains stationary in the track 146. The base 152 includes a flat portion 154 contacting the base of the track 146 and extending laterally to respective bend portions 156 at the side edges of the track, which then bend backward and inwardly toward the center of the track. Before the bend portions 156 meet, they curve backwardly and outwardly into respective curved portions 158 which engage and curve around the grooves of the socket. The curved portions terminate in circular end portions 160 used to grasp and hold the curved portions 158 so that the socket and lamp assembly can be inserted and removed. The portions 160 also permit repositioning of the clip when the socket and lamp assembly is removed. This clip configuration allows for easy adjustment of the lamp centers. After the socket and lamp assembly is removed, the open ends of the clip are squeezed at the same time as pushing down slightly toward the track. The clip can then be slid along the track to the desired position, after which the socket and lamp assembly is reinstalled. This configuration may be used beneficially as well to optimize the illumination of objects based on lamp position.

The clips 40 and 150 form spring biased holders mountable to a mounting surface, such as the track. The clips permit the socket body and connectors, to be aligned with the lamp and hold the sockets through resilient arms engaging the socket bodies, preferably through grooves in the socket bodies.

In the preferred embodiment, the inside diameter of the clip 40 is about one sixteenth of an inch smaller than the outside diameter of the first and second grooves in the fixed socket, to ensure a secure fit. For the expansion socket, the inside diameter of the top clip is preferably sized to allow a slip fit between the groove and the clip, to allow appropriate movement between the expansion socket and its corresponding clip, while still holding the socket securely in place.

It should be understood that the drawings are dimensioned to adequately show the features of the invention. However, the relative dimensions of the parts can be modified without departing from the spirit of the invention. For example, one feature of the invention can be modified or its benefit reduced in order to accommodate another goal or function of another feature of the invention. For example, mechanical support of the bulb by the socket and the O-ring can be reduced somewhat by decreasing the overall length of the socket so that the O-ring seals around the bulb closer to the metal neck portion 110. Preferably, the socket still provides some thermal insulation around the electrode portion of the lamp. Reducing the overall length of the socket would also ensure that the maximum amount of illumination from the lamp is achieved. Preferably, the length of the bore into which the lamp is inserted is sufficient to cover the pins and the end face of the lamp as well as covering part of the electrode area of the lamp for thermal insulation. Additionally, the socket material could be of a type, such as an acrylic, a polycarbonate or a lexan material, that allows light to pass through from the lamp to the outside, to help illuminate the target surface. Alternatively, only that portion of the socket that covers the illuminated part of the lamp could be made of such a translucent or clear material.

The lamps, sockets, lamp and socket combinations, and the lighting fixtures described herein reduce or eliminate problems caused by contamination from cleaning procedures, repair, replacement and installation procedures and operations, and environmental conditions during operation. It is believed that the inventions disclosed herein reduce the possibility of high open circuit voltage shock or damage and can be used with equipment having higher operating voltages, higher frequencies and higher currents. It is also believed that the inventions described herein are particularly applicable to extreme environmental conditions, such as outdoors, freezer and storage applications, and the like. The expansion and contraction of hardware and the bending of sockets by thermal expansion and contraction or by damage from installation or repair, or by simple miscalculation in positioning is accommodated by the present inventions. Environmental conditions such as high humidity and icing are also minimized by the present inventions. The described inventions also accommodate different lighting elements, different sizes of lighting elements and other variations in lighting systems. They also account for vibration and other mechanical effects, such as may be caused by wind, heavy traffic, repair replacement and cleaning, stocking, and the like wherein in the past such vibration or mechanical impact may have caused disconnection or withdrawal of lamp pins partially from sockets. It is believed that the present inventions maintain good integrity electrical contact and damp any effects of vibration. As a result, it is believed that the effects of these problems in conventional systems such as arcing, potential electric shock, and the like, is reduced or eliminated.

To assemble a lighting system such as that described herein, mounting clips 40 (or 150) are attached to are mounted on a substrate 38 either fixedly or adjustably in a track 146 such as that shown in FIG. 13. An appropriately sized lamp and corresponding insulator and socket are assembled by placing an insulator over each end of the lamp and ensuring the insulator is relatively fixed on each end of the lamp. A first end of the lamp is then inserted into the bore of a socket, using whatever indicators or guides may be provided until the pins of the lamp engage the slotted connectors in the base of the socket. A good wiping action is achieved as the pins enter the connectors 50 and the barbs 78 are pushed out to engage the material of the insulator, as shown in FIG. 11. Similar steps are followed with respect to the socket and insulator for the other end of the lamp. The socket and lamp assembly is then mounted through engagement with the clips 40 (or 150) in such a way that the expansion socket engaging its clip has sufficient room to move to accommodate any expansion or contraction of the substrate or base material 38. The procedure can be modified accordingly if the insulator is designed to also cover portions of the end of the lamp and a simple connector is to be used to connect the conductors 52 to the pins 54.

To adapt to a lamp of a different or small size, such as a T-5 lamp, insulators are placed on or over the ends of the lamp and the respective sockets fitted with appropriate adapters. The fitting of the adapters to the sockets can be made easier by the use of appropriate keys, indicators or other signs for proper alignment. The sockets and bulbs are then assembled and mounted to an appropriate substrate in a manner similar to that previously described. The length of the adapter is preferably sufficient to provide guidance for the T-5 lamp as well as the structural support for the end of the lamp.

A lighting system for a refrigeration unit is one application of the embodiments of the present invention, and while it is representative of the extreme conditions in which a lighting system is often operated, it is not the exclusive application for the present invention. The present invention may find application in lighting systems for outdoor illumination, storage boxes, underground lighting systems, as well as cold storage rooms and other refrigeration units. However, the description herein will be directed primarily to refrigeration units.

Figure 15:
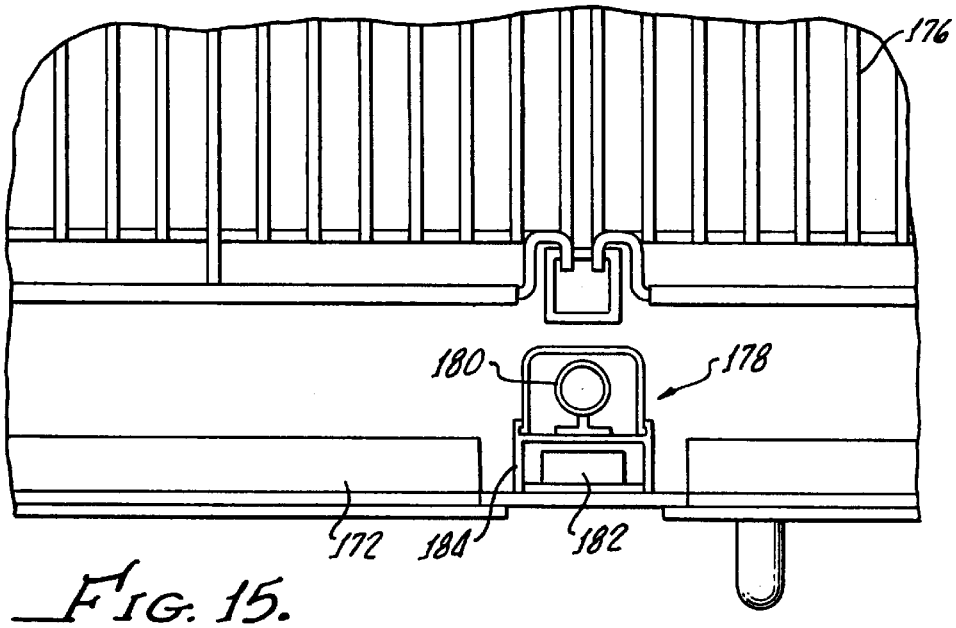
FIG. 15 is a partial schematic and partial horizontal sectional view of part of a refrigerated case showing a lighting system mounted therein.

In accordance with one aspect of the present invention, the lighting system can be used in a refrigerated display case 170, typically including doors 172 set in a surrounding frame 174 for enclosing product (not shown) displayed on shelves 176. Such display cases are commonly found in grocery stores, convenience markets, and the like. As shown in FIG. 15, the display case would include a lighting system 178 for illuminating product stored on the shelves 176 for display. Customers can access and remove product through the doors 172 (shown schematically in FIG. 15). The lighting system typically includes a light source 180, such as a fluorescent lamp having a cathode and anode and a discharge gas contained in the tube between the cathode and the anode. A ballast 182 may be positioned inside a mullion 184 or elsewhere in the case to drive the fluorescent lamps. The ballast can be wired in the conventional manner, as known to those skilled in the art.

It is to be understood that the embodiments of the invention disclosed herein are illustrative of the principles of the invention and that other modifications may be employed which are still within the scope of the invention. Accordingly, the present invention is not limited to those embodiments precisely shown and described in the specification.

What is claimed is:

1. A socket for a lighting assembly, the socket comprising:

a rigid socket body with a base wall and a unitary second wall formed integral with and extending a first distance from the base wall for defining an enclosure and a rim at an end of the second wall such that a lighting element with a pin contact can extend past the rim into the enclosure and wherein the second wall includes a seal element for sealing between the second wall and a lighting element; and at least one cylindrical electrical connector spaced from the second wall and wherein the connector is shaped so as to contact a pin contact on a lighting element over a substantial portion of the length of the pin, wherein the cylindrical connector extends from the base wall into the enclosure to a point within the enclosure spaced from the rim.

2. The socket of claim 1 wherein the seal is an O-ring seal element positioned adjacent the rim.

3. The socket of claim 2 wherein the second wall includes an interior surface and wherein the O-ring seal is positioned on the interior surface of the second wall.

4. The socket of claim 1 wherein the second wall includes an outer surface and wherein the outer surface includes at least one engagement surface for accepting a support for supporting the socket.

5. The socket of claim 4 wherein the engagement surface is a groove extending about a circumference of the second wall.

6. The socket of claim 5 wherein the groove has a longitudinal width and wherein the socket includes the support for supporting the socket and wherein the support for supporting the socket includes a support element having a longitudinal width approximately the same as the longitudinal width of the groove.

7. The socket of claim 5 wherein the groove has a longitudinal width and wherein the socket includes the support for supporting the socket and wherein the support further includes a support element having a longitudinal width smaller than the longitudinal width of the groove.

8. The socket of claim 5 wherein the groove on the socket has a shape and wherein the socket further includes a support for supporting the socket including a support element having a configuration at least in part conforming to the shape of the groove.

9. A socket for a lighting assembly, the socket comprising:

a rigid socket body with a base wall and a unitary second wall formed integral with and extending a first distance from the base wall for defining an enclosure and a rim at an end of the second wall such that a lighting element with a pin contact can extend past the rim into the enclosure, wherein the second wall includes a seal element for sealing between the second wall and a lighting element, and wherein the second wall includes an outer surface and wherein the outer surface includes at least one engagement surface for accepting a support for supporting the socket, wherein the engagement surface is at least two grooves spaced, longitudinally relative to each other; and at least one cylindrical electrical connector spaced from the second wall and wherein the connector is shaped so as to contact a pin contact on a lighting element over a substantial portion of the length of the pin.

10. A socket and lamp assembly for a lighting assembly, the socket comprising:

a socket body with a base wall and a second, housing wall extending a first distance from the base wall for defining an enclosure for receiving an end of a lighting element and a rim at an end of the enclosure such that a lighting element having a pin contact can extend past the rim into the enclosure;

at least one cylindrical electrical connector spaced from the second wall and extending into the enclosure from the base wall only part way to the rim of the enclosure for contacting a pin contact on a lighting element wherein the second wall extends past the end of the cylindrical connector, wherein the at least one cylindrical connector includes two cylindrical connectors spaced apart from each other and extending from the base wall of the socket, wherein the second wall defines an interior surface which is substantially circular to accept the lighting element and the second wall extends from the base wall a distance at least twice the first distance and further including a lighting element in the form of a lamp having a lamp body, a lamp end at an end of the body having a base and two pin contacts extending away from the lamp base and wherein the lighting element extends into the socket such that the pin contacts electrically contact the cylindrical connectors and wherein the second wall extends around the pin contacts on the lamp and past the base of the lamp to enclose the base and at least part of the lamp body.

11. The assembly of claim 10 wherein the socket is a rigid socket, wherein the socket body has an axis, and wherein the cylindrical connectors are aligned substantially parallel to the axis of the body of the socket.

12. The assembly of claim 11 further comprising a seal for sealing around the lamp.

13. The assembly of claim 12 wherein the second wall includes an O-ring groove adjacent the rim for sealing between the lamp and the socket wall.

14. The assembly of claim 13 wherein the socket further includes conductors for supplying current to the cylindrical connectors and a wall defining an opening for the conductors and further comprising a seal for the conductors so that the socket connection is sealed inside the socket.

15. A socket for a lighting assembly, the socket comprising:

a socket body with a base wall and a second, housing wall extending a first distance, from the base wall for defining an enclosure for receiving an end of a lighting element and a rim at an end of the enclosure such that a lighting element having a pin contact can extend past the rim into the enclosure;

at least one cylindrical electrical connector spaced from the second wall and extending into the enclosure from the base wall only part way to the rim of the enclosure for contacting a pin contact on a lighting element wherein the second wall extends past the end of the cylindrical connector; and wherein the second wall includes a seal element for sealing between the second wall and a lighting element.

16. The socket of claim 15 wherein seal element includes an O-ring seal positioned in the second wall.

17. A socket and holder assembly for a lighting assembly, the socket comprising:

a socket body with a base wall and a second wall extending a first distance from the base wall for defining an enclosure and a rim at an end of the enclosure such that a lighting element with a pin contact can extend past the rim into the enclosure and the socket further includes a groove extending about a circumference of the second wall for accepting the holder;

at least one cylindrical electrical connector spaced from the second wall for contacting a connector on a lighting element;

a holder for the socket body and wherein the holder and the socket body are movable at least one of rotatably and slidably relative to each other and the holder further including a mounting element for mounting the holder to a mounting surface; and further comprising a second groove spaced from the first groove for accepting a holder.

18. A socket for a lighting assembly, the socket comprising:

a socket body with a base wall having a center, and a second wall extending a first distance from the base wall for defining an enclosure and a rim at an end of the enclosure such that a lighting element with a pin contact can extend past the rim into the enclosure;

at least two pair of cylindrical electrical connectors, wherein at least two of the pairs of conductors are non-colinear relative to each other, wherein each connector in each pair is positioned approximately equidistant from a center of the base wall relative to the other connector in the pair, wherein each connector in each pair has a spacing distance from the other connector in the respective pair, and wherein the spacing for one pair is different than the spacing for the other pair, wherein the at least two pair of connectors are oriented in an approximate crisscross pattern and wherein the first pair of connectors accept pins from a T-8 sized fluorescent lamp and wherein the second pair of connectors accept pins from a T-5 sized fluorescent lamp.

19. The socket of claim 18 further comprising an indicator on the socket indicating the relative position in the socket of at least one of the cylindrical connectors.

20. The socket of claim 18 wherein the connectors are spaced from the second wall and extend a second distance less than the first distance from the base wall for contacting connectors on a lighting element.

21. A socket and lamp, the socket and lamp comprising:

a socket body including a base and at least one electrical connector for contacting a contact on a lamp;

a lamp having an end and a pin contact on the end and a body for passing light out of the lamp, and wherein the lamp includes an insulator on the end of the lamp separable from the socket body for protecting the pin contact on the end of the lamp;

wherein the pin contact is engaged with the connector and wherein the connector includes a projection engaging the insulator; and wherein the projection includes a barb on the connector, the barb being biased outwardly.

22. The socket and lamp of claim 21 wherein the socket includes four connectors, each of which includes a barb engaging the insulator.

23. The socket and lamp of claim 21 wherein the socket further includes alignment indicators for indicating the location of the lamp contact.

24. A socket and lamp and insulator combination, the combination comprising:

a lamp having a body and at least one end with a pin contact having a first diameter on the end of the lamp;

an insulator covering the end of the lamp and the pin contact and the insulator having a wall defining an opening in at least one surface of the insulator having a diameter less than the diameter of the pin to provide an interference fit; and a socket having a socket body and including at least one electrical connector extending longitudinally of the socket for contacting the pin contact on the lamp, and wherein the socket body extends over the lamp such that the electrical connector engages the pin contact and the insulator and wherein the socket encloses a portion of the lamp body.

25. The combination of claim 24 wherein the at least one electrical connector includes engagement means for engaging the insulator on the lamp.

26. The combination of claim 25 wherein the engagement means includes a barb.

27. A socket assembly for a lighting assembly, the socket comprising:

a rigid socket body with a base wall and a unitary second wall formed integral with and extending a first distance from the base wall for defining an enclosure and a rim at an end of the second wall such that a lighting element with a pin contact can extend past the rim into the enclosure and wherein the second wall includes a seal element for sealing between the second wall and a lighting element;

a support engaging the socket body;

at least one cylindrical electrical connector spaced from the second wall and wherein the connector is shaped so as to contact a pin contact on a lighting element over a substantial portion of the length of the pin and wherein the cylindrical connector extends from the base wall into the enclosure to a point within the enclosure spaced from the rim.

28. The socket of claim 27 wherein the seal is an O-ring seal element positioned adjacent the rim.

29. The socket of claim 28 wherein the second wall includes an interior surface and wherein the O-ring seal is positioned on the interior surface of the second wall.

30. The socket of claim 27 wherein the second wall includes an outer surface and wherein the outer surface includes at least one engagement surface for accepting the support for supporting the socket.

31. The socket of claim 30 wherein the engagement surface is a groove extending about a circumference of the second wall.

32. The socket of claim 31 wherein the groove has a longitudinal width and wherein the support for supporting the socket-includes a support element having a longitudinal width approximately the same as the longitudinal width of the groove.

33. The socket of claim 31 wherein the groove has a longitudinal width and wherein the support further includes a support element having a longitudinal width smaller than the longitudinal width of the groove.

34. The socket of claim 31 wherein the groove on the socket has a shape and wherein the support for supporting the socket includes a support element having a configuration at least in part conforming to the shape of the groove.

35. A socket assembly for a lighting assembly, the socket comprising:

a rigid socket body with a base wall and a unitary second wall formed integral with and extending a first distance from the base wall for defining an enclosure and a rim at an end of the second wall such that a lighting element with a pin contact can extend past the rim into the enclosure, wherein the second wall includes a seal element for sealing between the second wall and a lighting element and wherein the second wall includes an outer surface and wherein the outer surface includes at least one engagement surface for accepting the support for supporting the socket and the engagement surface is at least two grooves spaced longitudinally relative to each other;

a support engaging the socket body; and at least one cylindrical electrical connector spaced from the second wall and wherein the connector is shaped so as to contact a pin contact on a lighting element over a substantial portion of the length of the pin.

wherein the engagement surface is at least two grooves spaced longitudinally relative to each other.

36. A light assembly, the assembly comprising:

a first socket body having a base wall and a second wall extending a first distance from the base wall for defining an enclosure and having a rim at an end of the enclosure such that a lamp with a pin contact can extend past the rim into the enclosure; and at least one cylindrical electrical connector spaced from the second wall and extending a second distance less than the first distance from the base wall for contacting a contact on a lighting element wherein the second wall extends past the end of the cylindrical connector;

a second socket having a second socket body;

a holder for the first socket body wherein the holder is movable at least one of rotatably and longitudinally relative to the socket body and the holder further including a mounting element for mounting the holder to a mounting surface;

a holder for the second socket body;

a lamp having first and second ends and respective electrical contacts on the first and second ends, the first end inserted into the first socket and having contacts connected to the contacts in the socket and the second end inserted into the second socket and having contacts connected to contacts in the second socket and wherein the sockets are aligned with the longitudinal axis of the lamp.

37. The assembly of claim 36 wherein the first socket body is formed from a rigid plastic material.

38. The assembly of claim 36 wherein the enclosure of the first socket body encloses part of the lamp.

39. The assembly of claim 38 wherein the second wall extends from the baseball a distance sufficient to extend to appoint adjacent a filament of the lamp.

40. The assembly of claim 36 wherein the at least one cylindrical electrical connector is a split sleeve connector.

41. The assembly of claim 40 wherein the split sleeve connector extends from the base wall into the enclosure less than halfway along a length of the enclosure.

42. The assembly of claim 40 further including wires extending out of the first socket in a direction opposite the rim.

43. The assembly of claim 36 wherein the first socket further comprises a seal for sealing around the lamp.

44. The assembly of claim 43 wherein the second wall of the first socket includes an O-ring groove adjacent the rim for sealing between the lamp and the first socket wall.

45. The assembly of claim 36 wherein the rim of the first socket defines an opening in the first socket having a first diameter and further comprising an adaptor for reducing the size of the opening in the first socket for accepting a lamp having a smaller diameter.

46. The assembly of claim 45 wherein the adaptor includes a sealing element on an internal surface for forming a seal between the lamp and the adaptor.

47. The assembly of claim 46 wherein the first socket includes a key surface and wherein the adaptor further includes a key way for engaging the key surface on the first socket.

48. The assembly of claim 46 wherein the sealing element of the adapter is sized to seal about a T-5 lamp.

49. The assembly of claim 45 wherein the adapter includes a cylindrical body for extending into the enclosure of the first socket and a wall at an end of the cylindrical body extending outwardly.

50. The assembly of claim 45 wherein the first socket includes two pair of cylindrical electrical connectors.

51. The assembly of claim 50 wherein the cylindrical electrical connectors in each pair have a spacing between them and wherein the spacing between the connectors in one pair is different than the spacing between the connectors in the other pair.

52. The assembly of claim 50 wherein one pair of electrical connectors is sized to accept a pin from a T-8 sized fluorescent lamp and wherein the other pair of electrical connectors is sized to accept a pin from a T-5 sized fluorescent lamp.

53. The assembly of claim 62 further including a support for supporting the first socket and a mounting surface to which the support is mounted.

54. The assembly of claim 53 wherein the support is movable relative to the mounting surface.

55. The assembly of claim 53 wherein the support for supporting the first socket includes a spring biased mounting element for engaging the mounting surface.

56. The assembly of claim 53 wherein the mounting surface includes a track.

57. The assembly of claim 56 wherein the track extends in a direction substantially parallel to the lamp.

58. The assembly of claim 53 further comprising a fastener for fastening the support to the mounting surface.

59. The assembly of claim 53 wherein the support is formed from metal.

60. The assembly of claim 62 wherein the first socket body is removable from the support.

61. The assembly of claim 62 wherein the support is formed from a resilient material.

62. The assembly of claim 36 wherein the second wall of the first socket includes an outer surface and wherein the outer surface includes at least one engagement surface forming a groove for accepting a support for supporting the first socket.

63. The assembly of claim 62 wherein the engagement surface is a groove extending about a circumference of the second wall.

64. The assembly of claim 62 wherein the groove of the first socket has a longitudinal width and wherein the first socket further includes a support for supporting the first socket including a support element having a longitudinal width approximately the same as the longitudinal width of the groove of the first socket.

65. The assembly of claim 62 wherein the groove of the first socket has a longitudinal width and wherein the first socket further includes a support for supporting the first socket including a support element having a longitudinal width smaller than the longitudinal width of the groove of the first socket.

66. The assembly of claim 62 wherein the groove on the first socket has a shape and wherein the first socket further includes a support for supporting the first socket including a support element having a configuration at least in part conforming to the shape of the groove of the first socket.

67. The assembly of claim 62 wherein the engagement surface is at least two grooves spaced longitudinally relative to each other.

68. The assembly of wherein 67 the lamp further includes an insulator and wherein the electrical connector in the first socket includes a projection on the connector biased outwardly into the insulator.

69. The assembly of claim 68 wherein the first socket includes four connectors, each of which includes a projection in the form of a barb engaging the insulator.

* * * * *